US007358671B2

(12) United States Patent
Kwon et al.

(10) Patent No.: US 7,358,671 B2
(45) Date of Patent: Apr. 15, 2008

(54) PLASMA DISPLAY PANEL HAVING INDENTED SUSTAIN ELECTRODE

(75) Inventors: Jae-Ik Kwon, Asan-si (KR); Kyoung-Doo Kang, Seoul (KR)

(73) Assignee: Samsung SDI Co., Ltd., Suwon-si (KR)

( * ) Notice: Subject to any disclaimer, the term of this patent is extended or adjusted under 35 U.S.C. 154(b) by 115 days.

(21) Appl. No.: 10/890,660

(22) Filed: Jul. 13, 2004

(65) Prior Publication Data

US 2005/0029941 A1 Feb. 10, 2005

(30) Foreign Application Priority Data

Aug. 5, 2003 (KR) ..... 10-2003-0054055

(51) Int. Cl.
*H01J 17/00* (2006.01)
*H01J 17/49* (2006.01)

(52) U.S. Cl. ..... 313/584; 313/581; 313/582; 313/583

(58) Field of Classification Search ..... 313/582–587; 315/169.4

See application file for complete search history.

(56) References Cited

U.S. PATENT DOCUMENTS 5,640,068 A * 6/1997 Amemiya ..... 313/582
6,376,986 B1 4/2002 Takagi et al.
6,512,337 B2 1/2003 Hirano et al.
6,522,072 B1 * 2/2003 Yura et al. ..... 313/582
6,670,754 B1 * 12/2003 Murai et al. ..... 313/582
6,747,409 B1 * 6/2004 Han et al. ..... 313/582
6,803,722 B2 * 10/2004 Nakamura et al. ..... 313/582
6,819,046 B2 * 11/2004 Hirano ..... 313/582

(Continued)

FOREIGN PATENT DOCUMENTS

CN 1414595 4/2003

(Continued)

OTHER PUBLICATIONS

Korean Patent Abstracts for Publication No. 1019990065408A, Date of publication of application Aug. 5, 1999, in the name of Seung-Jae Lee.

*Primary Examiner*—Sikha Roy
*Assistant Examiner*—Natalie K. Walford
(74) *Attorney, Agent, or Firm*—Christie, Parker & Hale, LLP

(57) ABSTRACT

A plasma display panel (PDP) includes first and second substrates opposing one another with a predetermined gap therebetween. The PDP also includes address electrodes formed on a surface of the first substrate opposing the second substrate, and barrier ribs formed in the gap between the first and second substrates. The barrier ribs define discharge cells, and a phosphor layer is formed in each of the discharge cells. Further, discharge sustain electrodes made of a metal material are formed on a surface of the second substrate opposing the first substrate. The discharge sustain electrodes include line sections, each pair of which is formed corresponding to each discharge cell, and extensions are formed extending from the line sections into each of the discharge cells to define openings. Also, indentations are formed in distal ends of each of the extensions such that discharge gaps of differing sizes are formed between each pair of the extensions.

34 Claims, 20 Drawing Sheets

U.S. PATENT DOCUMENTS

| | | | | |
|---|---|---|---|---|
| 6,838,826 | B2 * | 1/2005 | Lin et al. | 313/582 |
| 2004/0135508 | A1 * | 7/2004 | Kwon et al. | 313/582 |
| 2004/0135509 | A1 * | 7/2004 | Kwon et al. | 313/584 |
| 2004/0201350 | A1 * | 10/2004 | Kwon et al. | 313/582 |
| 2004/0256989 | A1 * | 12/2004 | Kim et al. | 313/584 |
| 2004/0263078 | A1 * | 12/2004 | Woo et al. | 313/584 |

FOREIGN PATENT DOCUMENTS

| | | |
|---|---|---|
| JP | 2002-245943 | 8/2002 |
| KR | 1999-0065408 A | 8/1999 |
| WO | WO 00/46832 | 8/2000 |
| WO | WO 02/017345 A1 | 8/2001 |

* cited by examiner

PLASMA DISPLAY PANEL HAVING INDENTED SUSTAIN ELECTRODE

CROSS REFERENCE TO RELATED APPLICATION

This application claims priority to and the benefit of Korea Patent Application No. 2003-0054055 filed on Aug. 5, 2003 in the Korean Intellectual Property Office, the entire content of which is incorporated herein by reference.

BACKGROUND OF THE INVENTION (a) Field of the Invention

The present invention relates to a plasma display panel (PDP), and more particularly, to discharge sustain electrodes of a PDP.

(b) Description of the Related Art

A PDP is a display device that uses vacuum ultraviolet rays generated by gas discharge in discharge cells to excite phosphors, thereby realizing the display of images. With its ability to realize high-resolution images, the PDP is emerging as one of the most popular flat panel display configurations used for wall-mounted televisions and other similar large-screen applications. The different types of PDPs include the AC PDP, DC PDP, and the hybrid PDP. The AC PDP utilizing a triode surface discharge structure is becoming the most common configuration.

In the AC PDP with a triode surface discharge structure, an address electrode, barrier ribs, and a phosphor layer are formed on a rear substrate corresponding to each discharge cell. Discharge sustain electrodes including scanning electrodes and display electrodes are formed on a front substrate. A dielectric layer is formed covering the address electrodes on the rear substrate, and, similarly, a dielectric layer is formed covering the discharge sustain electrodes on the front substrate. Also, discharge gas (typically an Ne—Xe compound gas) is filled in the discharge cells.

Using the above structure, an address voltage Va is applied between the address electrodes and the scanning electrodes such that address discharge occurs in the discharge cells. As a result of this address discharge, a charge is accumulated on the dielectric layer that is formed covering the discharge sustain electrodes. This charge is referred to as a wall charge. A space voltage formed between the scanning electrodes and the display electrodes as a result of the wall charge is referred to as a wall voltage Vw. The discharge cell in which illumination is to occur is selected by the wall charge.

Next, a discharge sustain voltage Vs is applied between the display electrode and the scanning electrode of the selected discharge cell. Plasma discharge is effected when the sum of the discharge sustain voltage Vs and the wall voltage Vw exceeds a discharge firing voltage Vf. Accordingly, vacuum ultraviolet rays are emitted from Xe atoms that are excited by plasma discharge. The vacuum ultraviolet rays excite phosphors so that they glow (i.e., emit visible light) and thereby enable color display.

In the PDP operating in this manner, the formation of the discharge sustain electrodes greatly affects sustain discharge characteristics. Transparent material such as indium tin oxide (ITO) is typically used for the conventional discharge sustain electrodes. That is, the conventional discharge sustain electrodes are typically transparent electrodes. This transparency allows visible light generated in the discharge cells to pass through the discharge sustain electrodes while the discharge sustain electrodes perform their function of effecting sustain discharge. A thickness of the transparent discharge sustain electrodes is approximately 1000-1300 Å.

However, the transparent electrodes used for the discharge sustain electrodes are expensive. Manufacturing costs are further increased by the fact that it is necessary to perform an additional patterning process of the transparent electrodes. In addition, because of the high resistance of the transparent electrodes, bus electrodes made of a metal with a low resistance are further needed.

As a result of these problems, many in the field are attempting to realize the discharge sustain electrodes using only metal electrodes instead of the transparent electrode/metal electrode combination. An example of such usage is disclosed in U.S. Pat. No. 6,522,072. In this patent, discharge sustain electrodes are formed using only metal electrodes that are cheaper to manufacture than transparent electrodes. However, discharge sustain electrodes made using metal electrodes such as in the referenced patent reduce an aperture ratio of the PDP such that illumination efficiency is decreased and screen brightness is reduced. If the space between adjacent metal electrodes positioned in discharge gaps is increased in an effort to enhance the aperture ratio, the discharge firing voltage is increased and sustain discharge becomes unstable. An improvement in this regard, therefore, is needed.

SUMMARY OF THE INVENTION

In one exemplary embodiment of the present invention, there is provided a plasma display panel that improves a formation of discharge sustain electrodes, which are realized through metal electrodes, to thereby reduce a discharge firing voltage, stabilize sustain discharge, and improve illumination efficiency.

In an exemplary embodiment of the present invention, a PDP includes first and second substrates opposing one another with a predetermined gap therebetween. The PDP also includes address electrodes formed on a surface of the first substrate opposing the second substrate, and barrier ribs formed in the gap between the first and second substrates. The barrier ribs define discharge cells, and a phosphor layer is formed in each of the discharge cells. Further, discharge sustain electrodes made of a metal material are formed on a surface of the second substrate opposing the first substrate. The discharge sustain electrodes include line sections, each pair of which is formed corresponding to each discharge cell, and extensions formed extending from the line sections into each of the discharge cells to define openings. Also, indentations are formed in distal ends of each of the extensions such that discharge gaps of differing sizes are formed between each pair of the extensions.

Areas of the distal ends of the extensions to both sides of the indentations are formed at a predetermined curvature, and the line sections and the extensions are formed to a width in the range of 20-150 μm.

The discharge sustain electrodes may further include first connectors such that one of the first connectors is extended within each of the openings to interconnect the corresponding line section and the indentation, and a pair of the first connectors may be extended within each of the openings. Also, the discharge sustain electrodes may further include a second connector formed in each of the openings in a direction substantially parallel to the direction of the line sections extensions, such that for each of the extensions the second connector extends from a first predetermined point of a first leg of one of the pairs of extensions and interconnects a second predetermined point on a second leg of the one of the pairs of extensions.

The discharge sustain electrodes may further include both first connectors such that one of the first connectors is extended within each of the openings to interconnect the corresponding line section and the indentation, and a second connector formed in each of the openings in a direction substantially parallel to the direction of the line sections such that for each of the extensions the second connector extends from a first predetermined point of a first leg of one of the pairs of extensions and interconnects a second predetermined point on a second leg of the one of the pairs of extensions. The discharge sustain electrodes may also include third connectors formed interconnecting distal ends of adjacent extensions.

The barrier ribs may be formed in a lattice configuration. Further, the barrier ribs define the discharge cells along the direction address electrodes are formed, and along a direction substantially perpendicular to the direction the address electrodes are formed. Non-discharge regions are also defined by the barrier ribs, the non-discharge regions being positioned within respective regions enclosed by adjacent first axes located through center points of adjacent discharge cells along a direction substantially perpendicular to the direction that the address electrodes are formed and by adjacent second axes located through center points of adjacent discharge cells along the direction that address electrodes are formed. In this case, ends of the discharge cells furthest from this center point where the first axes intersect the second axes decrease in width along the direction substantially perpendicular to the direction the address electrodes are formed as the distance from the center point is increased.

A width of each of the openings defined by the extensions is smaller at an area adjacent to where the extensions are connected to the line sections than at a distal end area of the extensions. The difference in the widths is made by bending the extensions to have a predetermined curvature or by bending the extensions at a predetermined angle such that the width at the area adjacent to where the extensions are connected to the line sections gradually decreases.

DETAILED DESCRIPTION

Figure 1:
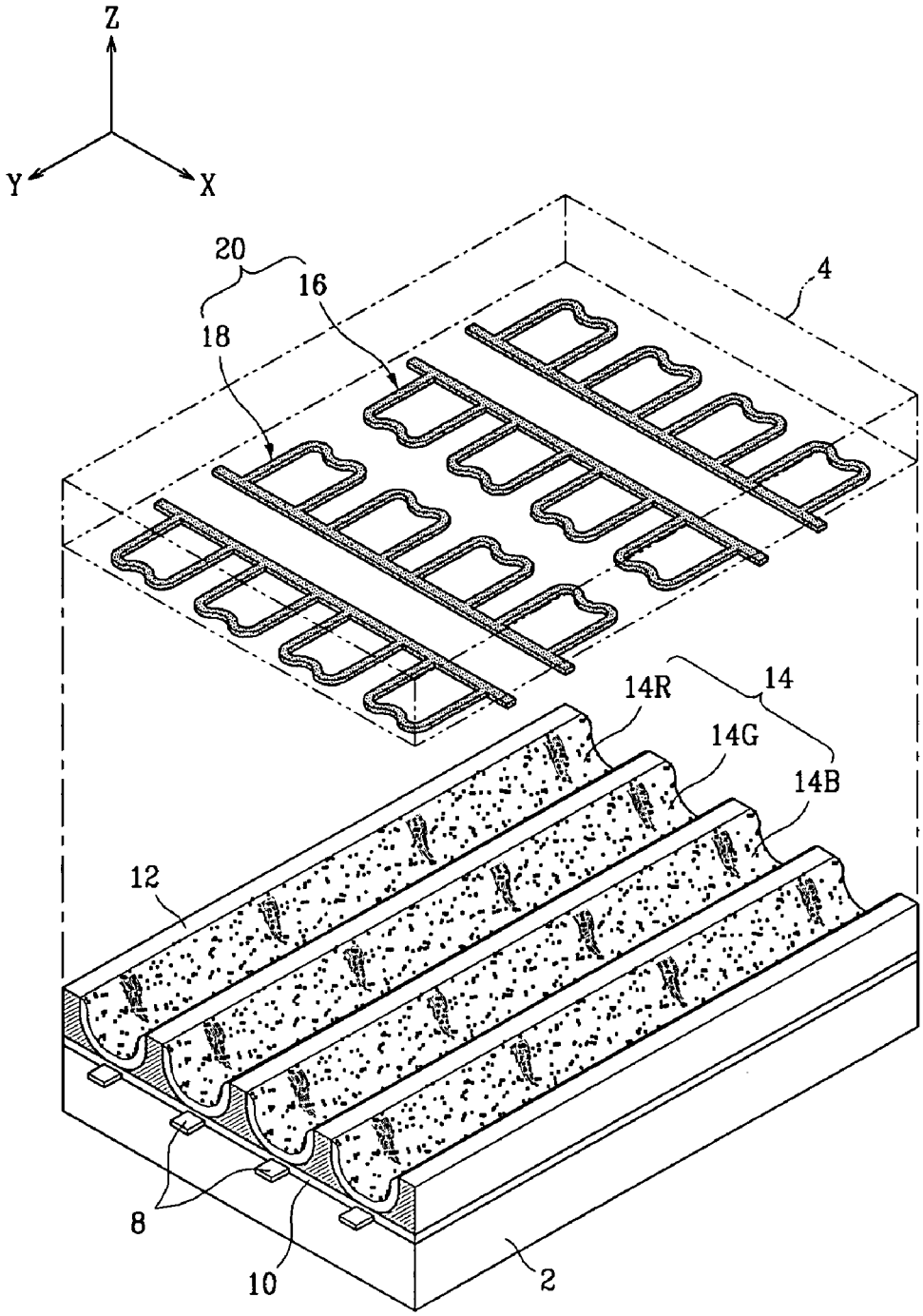
FIG. 1 is a partial exploded perspective view of a plasma display panel according to a first exemplary embodiment of the present invention.
Figure 2:
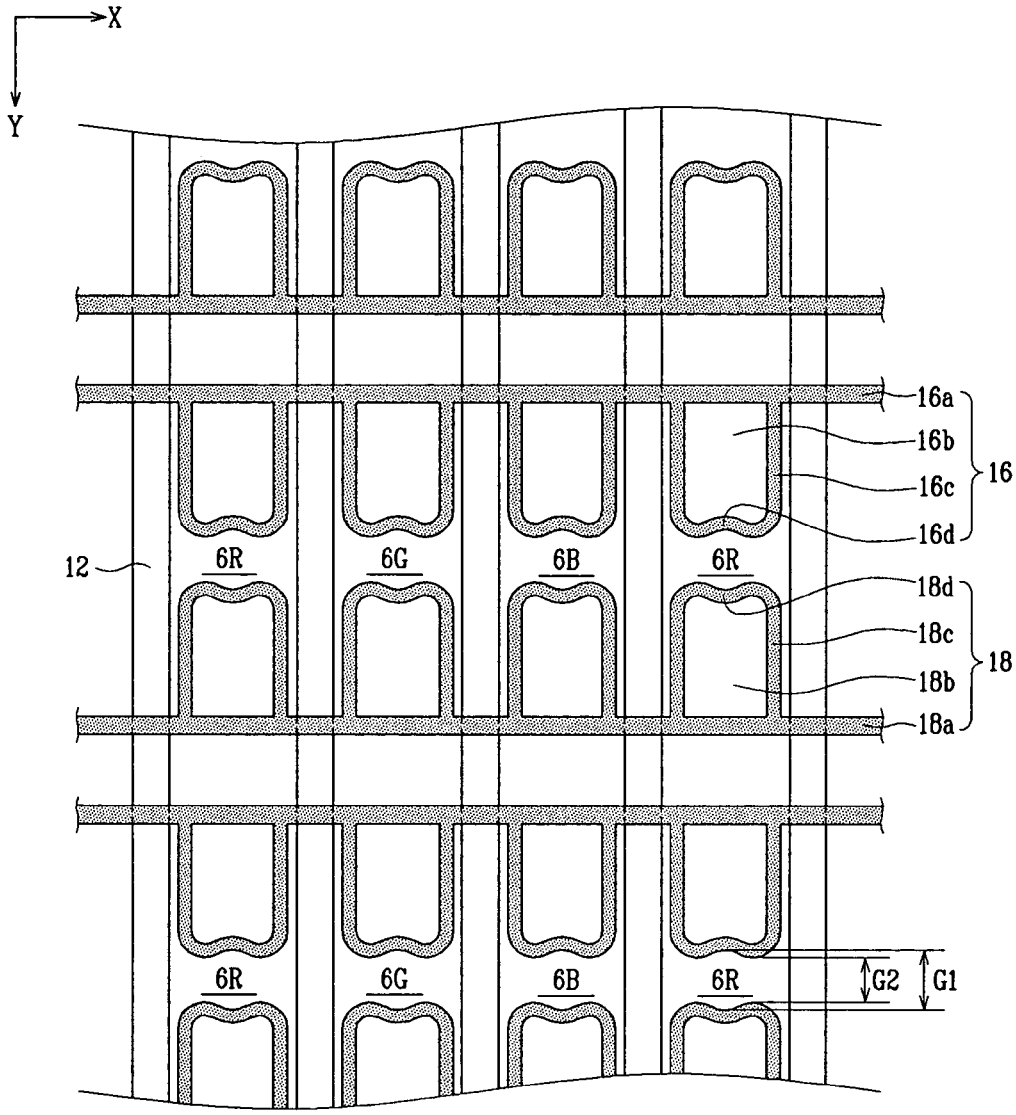
FIG. 2 is a plan view of the plasma display panel of FIG. 1.
Figure 3:
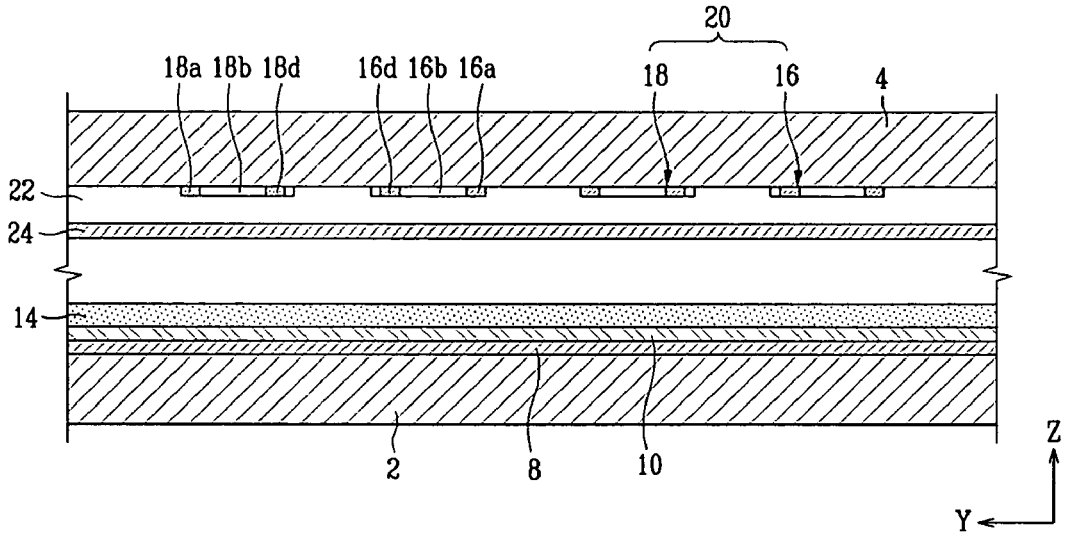
FIG. 3 is a sectional view of the plasma display panel of FIG. 1, in which the plasma display panel is shown in an assembled state.

Referring to FIGS. 1-5, the PDP according to a first exemplary embodiment of the present invention includes first substrate 2 and second substrate 4 provided opposing one another with a predetermined gap therebetween. Discharge cells 6R, 6G, 6B are formed in the gap between the first and second substrates 2, 4. Color images are realized by the emission of visible light generated by the independent discharge mechanism of each of the discharge cells 6R, 6G, 6B. The structure of the PDP will be described in greater detail below.

Address electrodes 8 are formed along one direction (direction Y in the drawings) on a surface of first substrate 2 opposing second substrate 4. As an example, address electrodes 8 are formed in a uniform stripe pattern with a predetermined gap between adjacent address electrodes 8. Lower dielectric layer 10 is formed on first substrate 2 covering address electrodes 8.

Barrier ribs 12 are formed on lower dielectric layer 10. As an example of their formation, barrier ribs 12 are also mounted in a stripe pattern with long axes parallel to long axes of address electrodes 8. Red, green, and blue phosphor layers 14R, 14G, 14B are formed between respective barrier ribs 12. That is, each of the red, green, and blue phosphor layers 14R, 14G, 14B is formed extending between a pair of adjacent barrier ribs 12 to cover an exposed portion of lower dielectric layer 10 therebetween and to be formed along opposing walls of the pair of adjacent barrier ribs 12. Barrier ribs 12 are formed between address electrodes 8, and are provided at a predetermined height. Discharge cells are defined by barrier ribs 12 through this configuration.

Formed on a surface of second substrate 4 opposing first substrate 2 are discharge sustain electrodes 20, each including scanning electrode 16 and display electrode 18. Discharge sustain electrodes 20 are formed along a direction (direction X in the drawings) that is substantially perpendicular to the direction address electrodes 8 are formed. Upper dielectric layer 22 is formed on second substrate 4 covering discharge sustain electrodes 20, and MgO protection layer 24 is formed covering upper dielectric layer 22.

Discharge cells 6R, 6G, 6B are formed in the regions where address electrodes 8 and discharge sustain electrodes 20 intersect. In more detail, a dimension of each of the discharge cells 6R, 6G, 6B in the direction X is defined by adjacent barrier ribs 12, while a dimension in the direction Y is defined by scanning electrode 16 and display electrode 18 forming one of the discharge sustain electrodes 20. Discharge gas (typically an Ne-Xe compound gas) is filled in discharge cells 6R, 6G, 6B.

Using this structure, an address voltage Va is applied between address electrodes 8 and scanning electrodes 16 to select a discharge cell for effecting illumination through address discharge. If a discharge sustain voltage Vs is applied between scanning electrode 16 and display electrode 18 of the corresponding selected discharge cell, vacuum ultraviolet rays are emitted from Xe atoms that are excited by plasma discharge. The vacuum ultraviolet rays excite phosphor layers 14R, 14G, 14B of corresponding discharge cells 6R, 6G, 6B so that they glow and thereby enable color display.

Figure 4:
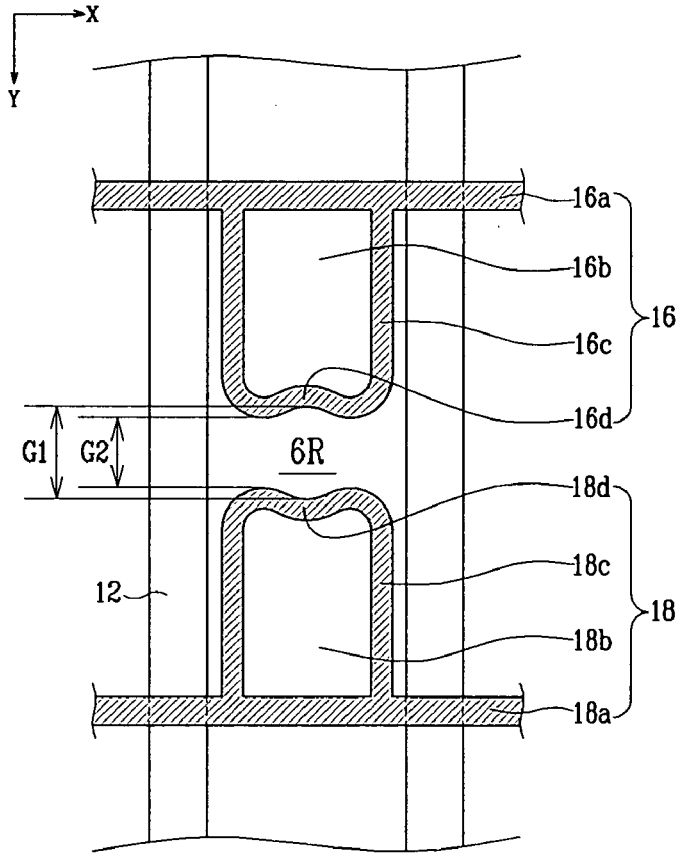
FIGS. 4 and 5 are partial enlarged views of FIG. 2.
Figure 5:
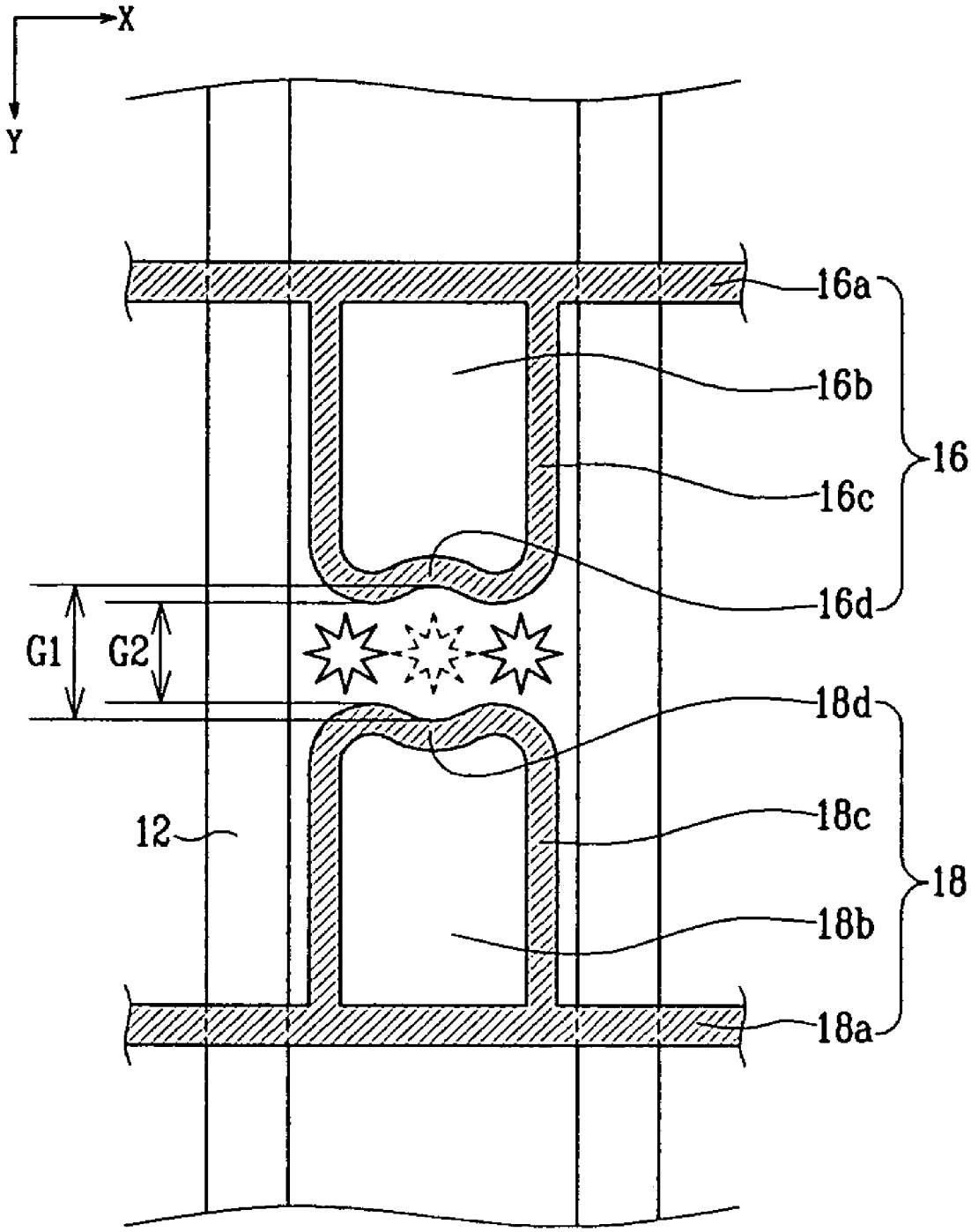

In the PDP of the present invention described above, discharge sustain electrodes 20 are formed using only metal electrodes (and no transparent electrodes). Also, a configuration of discharge sustain electrodes 20 is used that stabilizes sustain discharge while reducing a drive voltage needed for sustain discharge. FIGS. 4 and 5 are partial enlarged views of FIG. 2. The configuration of discharge sustain electrodes 20 will be described in detail with reference to FIGS. 2 and 4.

Each of the discharge sustain electrodes 20 includes one scanning electrode 16 and one display electrode 18 as described above. Using one scanning electrode 16 and one display electrode 18, as well as one discharge cell 6R as an example (with the understanding that the structure is the same for all the scanning electrodes 16, display electrodes 18, and discharge cells 6R, 6G, 6B), scanning electrode 16 includes line section 16*a* and display electrode 18 includes line section 18*a*. Line sections 16*a*, 18*a* define a lengthwise dimension of discharge cell 6R, that is, a dimension in the direction Y. Extension 16*c* is formed protruding into discharge cell 6R from line section 16*a*. Similarly, extension 18*c* is formed protruding into discharge cell 6R from line section 18*a*. Therefore, extensions 16*c*, 18*c* extend in a direction toward each other but are not formed to be long enough to make contact. Extensions 16*c*, 18*c* define openings 16*b*, 18*b*, respectively. That is, extensions 16*c*, 18*c* are formed in a closed-loop configuration to fully enclose and thereby define openings 16*b*, 18*b*. Visible light generated in discharge cell 6R passes through openings 16*b*, 18*b*, and through spaces formed to the outside of extensions 16*c*, 18*c* to be transmitted through second substrate 4.

In this exemplary embodiment of the present invention, protrusions 16*c*, 18*c* include indentations 16*d*, 18*d*, respectively, formed on distal, opposing ends respectively of extensions 16*c*, 18*c*. Therefore, enlarged first discharge gap G1 (i.e., a long gap) is formed between extensions 16*c*, 18*c* at an area corresponding approximately to a center area of discharge cell 6R. Further, second discharge gaps G2 (i.e., short gaps) are formed between extensions 16*c*, 18*c* at areas to both sides of indentations 16*d*, 18*d*, that is, at directly opposing areas substantially along direction Y between extensions 16*c*, 18*c*. Because of the formation of indentations 16*d*, 18*d*, first discharge gap G1 is larger than second discharge gap G2. These areas to both sides of extensions 16*c*, 18*c* may be formed at a predetermined curvature to ensure discharge stability.

Using this structure, if a discharge sustain voltage Vs is applied between scanning electrode 16 and display electrode 18, plasma discharge begins in second discharge gaps G2, then spreads into first gap G1. The areas where plasma discharge starts in this case are indicated by the spark-like illustrations drawn with a solid line in FIG. 5. Next, plasma discharge is initiated in first gap G1, which is substantially in the center of discharge cell 6R, 6G, 6B, then spreads into second gaps G2. The area where plasma discharge is initiated in this case is indicated by the spark-like illustration drawn with a hashed line in FIG. 5.

In the PDP of this exemplary embodiment, therefore, the strength of sustain discharge occurring in first discharge gap G1 is increased such that the drive voltage required for sustain discharge is reduced and sustain discharge occurs over a larger area. In addition, since sustain discharge of a greater intensity occurs in first discharge gap G1, and sustain discharge occurs substantially simultaneously in the center and outer areas of discharge cell 6R, 6G, 6B, illumination efficiency is improved, brightness within discharge cell 6R, 6G, 6B is made more uniform, and instantaneous brightness is enhanced.

Line sections 16*a*, 18*a* and extensions 16*c*, 18*c* of discharge sustain electrodes 20 are made of a metal material that is highly conductive such as silver (Ag). Widths of line sections 16*a*, 18*a* and of extensions 16*c*, 18*c* may be in the range of 20-150 μm so that resistance is not increased and a drop in aperture ratio does not occur. Discharge sustain electrodes 20 made of metal in this manner have an extremely low electrical resistance such that a large difference does not occur between (a) the voltage applied to line section 16*a* and the voltage at the end of extension 16*c*, and between the voltage applied to line section 18*a* and the voltage at the ends of extension 18*c*.

Various other exemplary embodiments of the present invention will now be described with reference to FIGS. 6-20.

Figure 6:
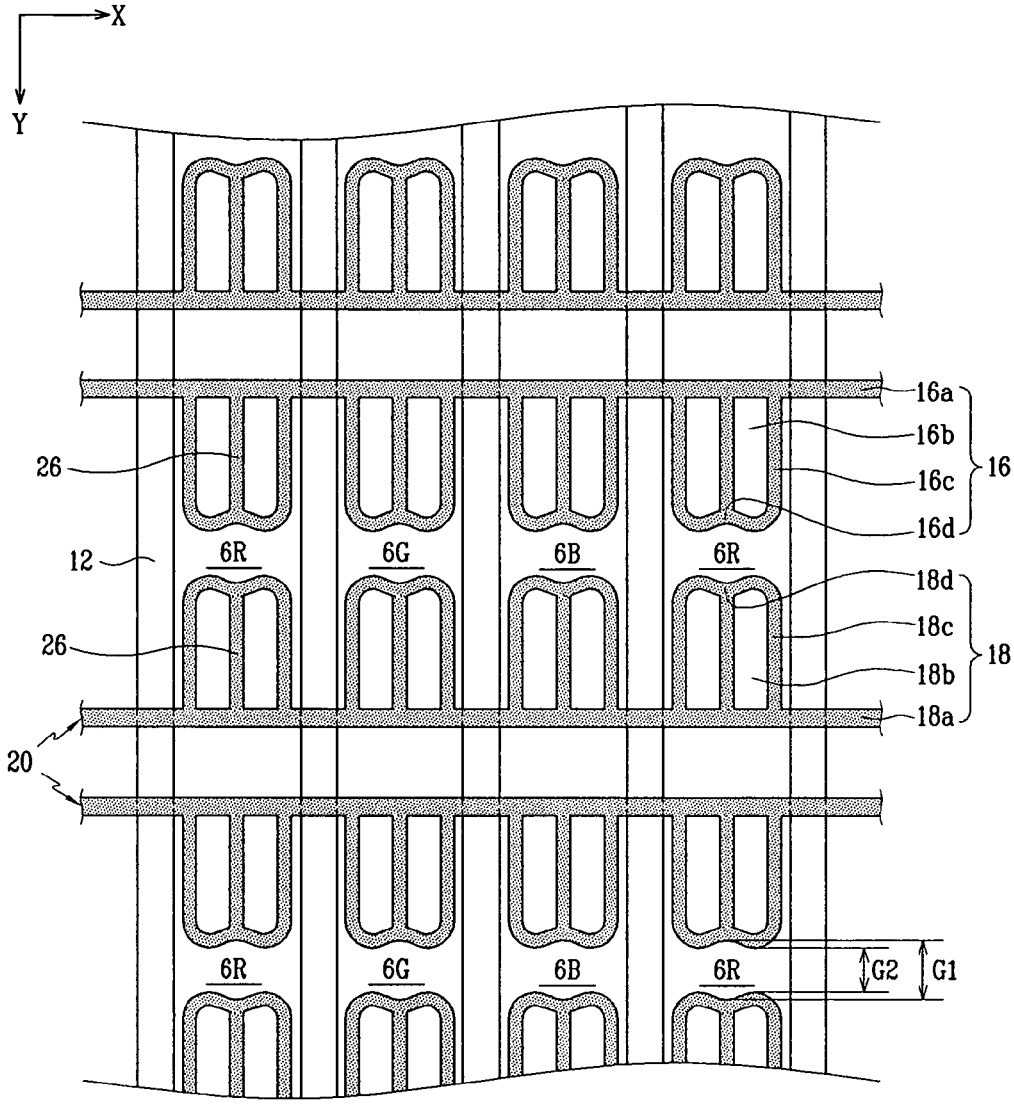
FIG. 6 is a partial plan view of a plasma display panel according to a second exemplary embodiment of the present invention.

FIG. 6 is a partial plan view of a plasma display panel according to a second exemplary embodiment of the present invention. Using the basic structure of the first exemplary embodiment of the present invention, first connectors 26 are extended within openings 16*b*, 18*b* from each of the line sections 16*a*, 18*a* to corresponding indentations 16*d*, 18*d*, respectively. First connectors 26 are formed along the direction of address electrodes 8 (not shown) to divide openings 16*b*, 18*b* roughly in half. During sustain discharge, ions and electrons generated in first and second discharge gaps G1, G2 flow along first connectors 26 toward exterior areas of discharge cells 6R, 6G, 6B to thereby enable sustain discharge to more easily spread.

Figure 7:
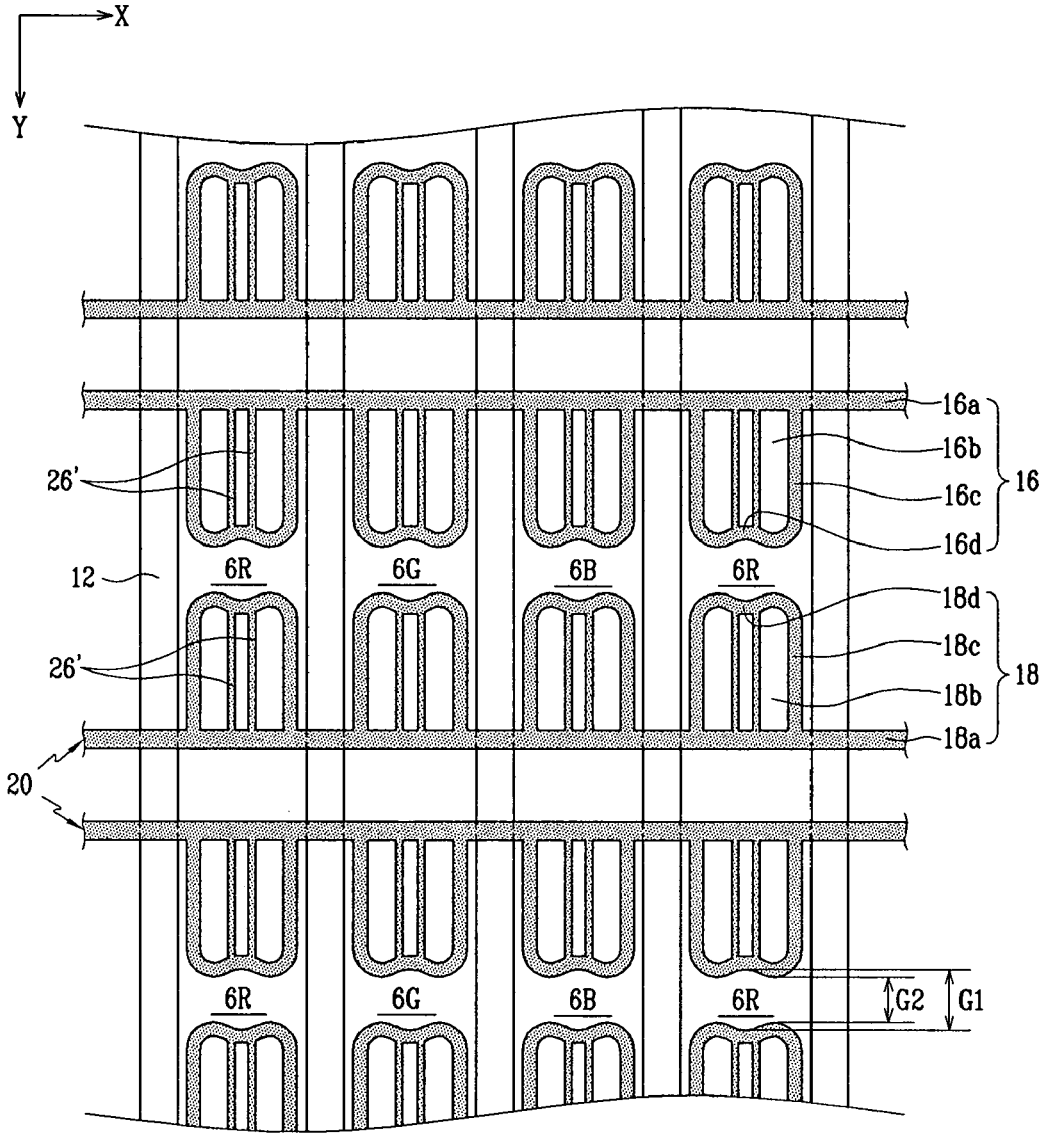
FIG. 7 is a partial plan view of a plasma display panel according to a third exemplary embodiment of the present invention.

FIG. 7 is a partial plan view of a plasma display panel according to a third exemplary embodiment of the present invention. Using the basic structure of the first exemplary embodiment of the present invention and similar to the structure of the second exemplary embodiment, a pair of first connectors 26' is formed in each of the openings 16*b*, 18*b*. That is, a pair of first connectors 26' extends from each of the line sections 16*a*, 18*a* to corresponding indentations 16*d*, 18*d*, respectively. This configuration enables an even easier spread of sustain discharge.

Figure 8:
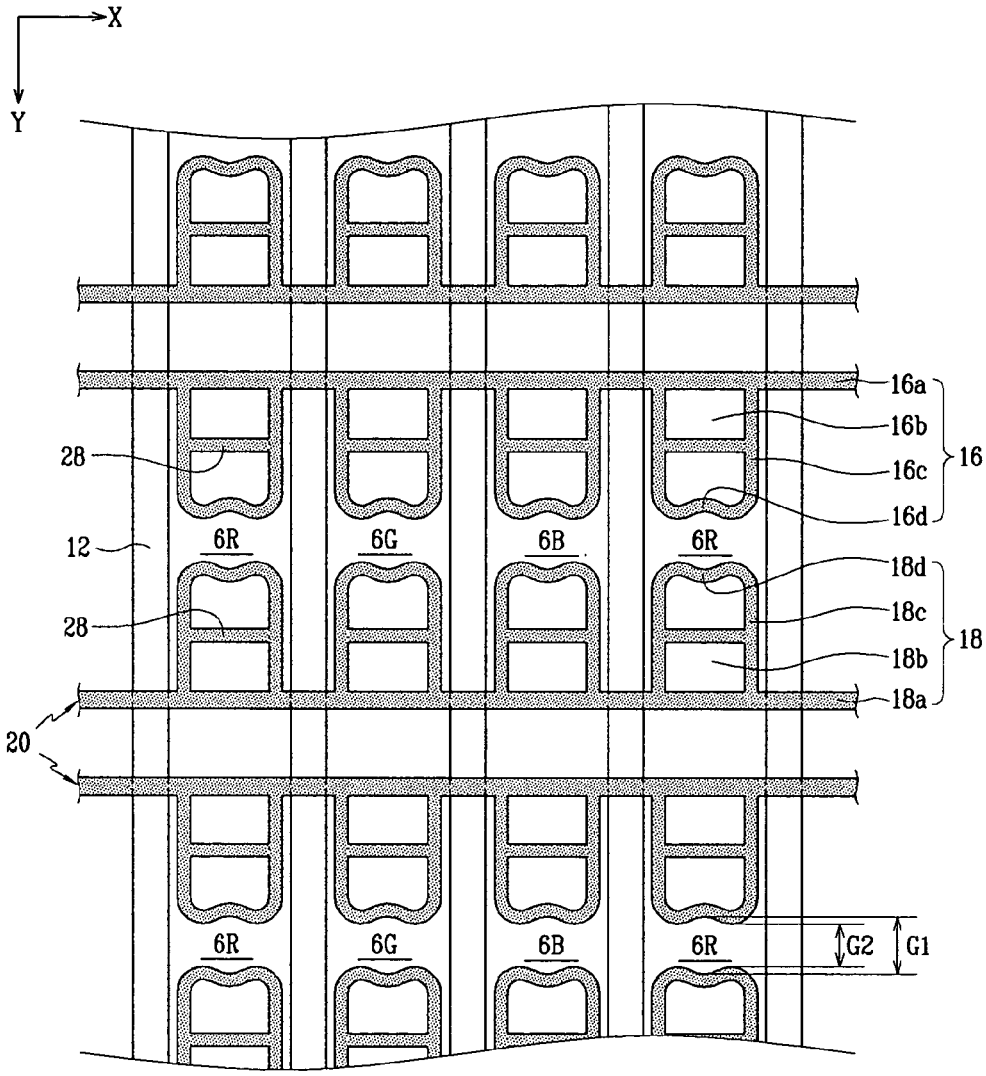
FIG. 8 is a partial plan view of a plasma display panel according to a fourth exemplary embodiment of the present invention.

FIG. 8 is a partial plan view of a plasma display panel according to a fourth exemplary embodiment of the present invention. Using the basic structure of the first exemplary embodiment of the present invention, second connector 28 is formed in each of the openings 16*b*, 18*b* in a direction substantially parallel to the direction of line sections 16*a*, 18*a*. For each of the extensions 16*c*, 18*c*, one of the second connectors 28 extends from one predetermined point of extensions 16*c*, 18*c* to a point of the same directly opposite to the first point to thereby interconnect these two areas of extensions 16*c*, 18*c*. During sustain discharge, second connectors 28 act such that ions and electrons generated in the space between scanning electrodes 16 and display electrodes 18 flow toward exterior areas of discharge cells 6R, 6B, 6B to thereby enable the easy spread of sustain discharge.

Figure 9:
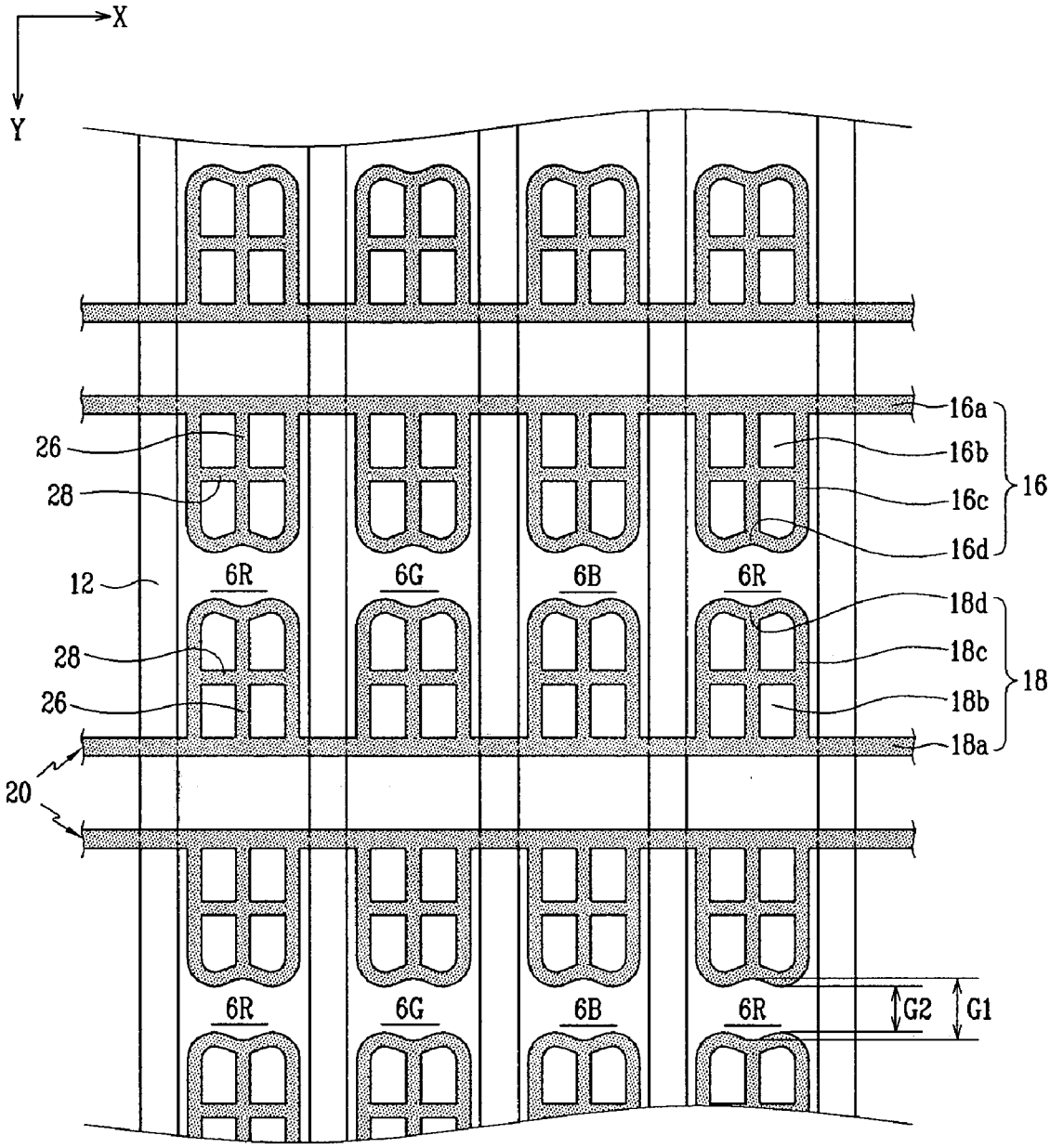
FIG. 9 is a partial plan view of a plasma display panel according to a fifth exemplary embodiment of the present invention.

FIG. 9 is a partial plan view of a plasma display panel according to a fifth exemplary embodiment of the present invention. This exemplary embodiment is a combination of the second and fourth exemplary embodiments of the present invention (both based on the structure of the first exemplary embodiment) shown respectively in FIGS. 6 and 8. That is, first connectors 26 are extended within openings 16*b*, 18*b* from each of the line sections 16*a*, 18*a* to corresponding indentations 16*d*, 18*d*, respectively. First connectors 26 are formed along the direction of the address electrodes 8 (not shown) to divide openings 16*b*, 18*b* roughly in half. Further, second connector 28 is formed in each of the openings 16*b*, 18*b* in a direction substantially parallel to the direction of line sections 16*a*, 18*a*. For each of the extensions 16*c*, 18*c*, one of the second connectors 28 extends from one predetermined point of extensions 16*c*, 18*c* to a point of the same directly opposite to the first point to thereby interconnect these two areas of extensions 16*c*, 18*c*. The function of first and second connectors 26, 28 is the same as described with reference to the second and fourth exemplary embodiments, respectively.

Figure 10:
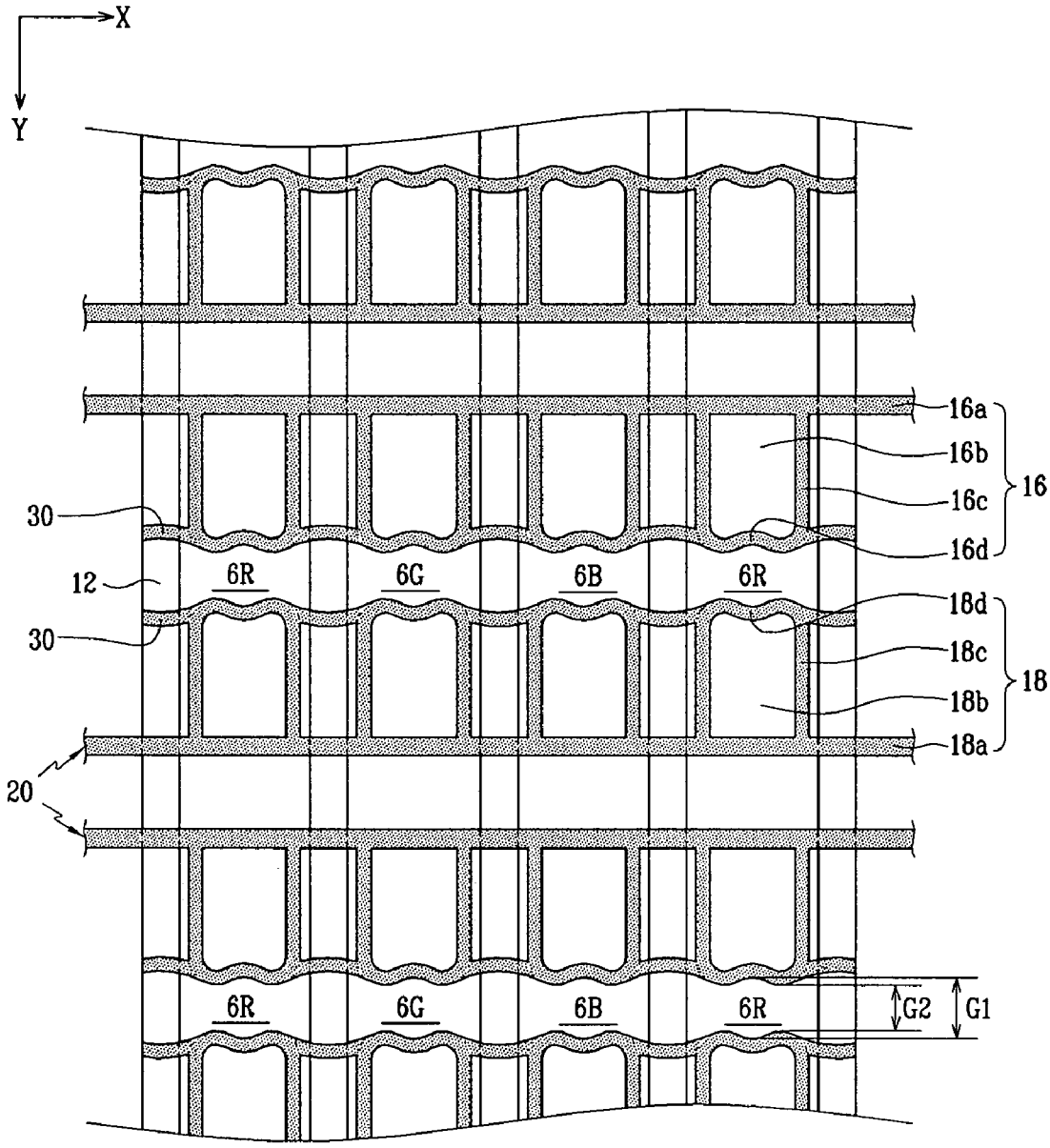
FIG. 10 is a partial plan view of a plasma display panel according to a sixth exemplary embodiment of the present invention.

FIG. 10 is a partial plan view of a plasma display panel according to a sixth exemplary embodiment of the present invention. Using the basic configuration of the first exemplary embodiment of the present invention, third connectors 30 are formed interconnecting distal ends of adjacent extensions 16*c*, 18*c*. Third connectors 30 enable a voltage to be applied to opposing surfaces of extensions 16*c*, 18*c* that is larger than in the above exemplary embodiments. Also, even if an open circuit occurs in line sections 16*a*, 18*a* (a situation that may occur as a result of the extremely small width of line sections 16*a*, 18*a*), third connectors 30 maintain the connection so that operation of the PDP is not disrupted. In addition, with the formation of third connectors 30 at areas corresponding to distal ends of barrier ribs 12 (as opposed to within discharge regions 6R, 6G,6B), screen brightness is not reduced by third connectors 30.

Figure 11:
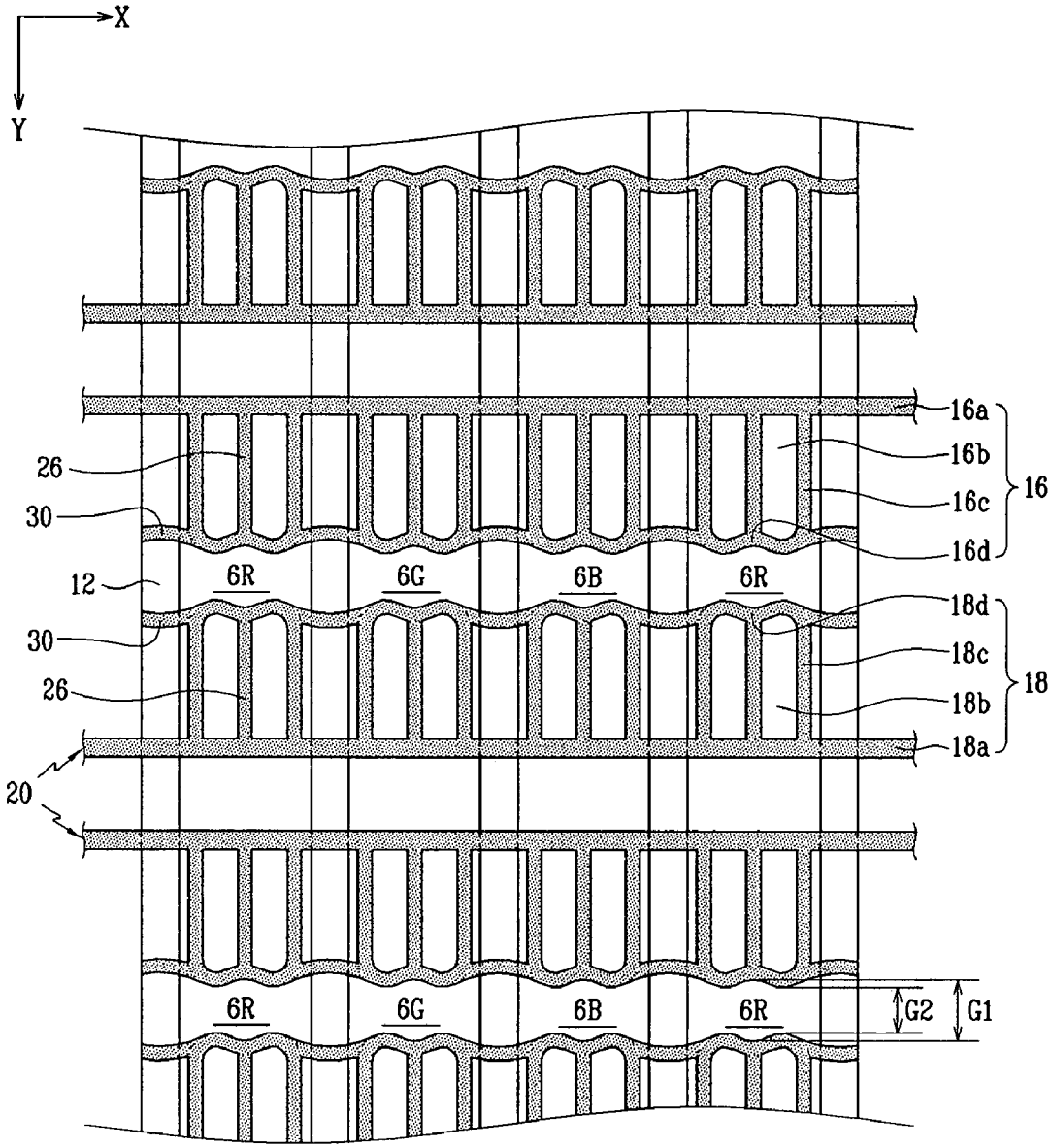
FIG. 11 is a partial plan view of a plasma display panel according to a seventh exemplary embodiment of the present invention.

FIG. 11 is a partial plan view of a plasma display panel according to a seventh exemplary embodiment of the present invention. This exemplary embodiment is a combination of the second and sixth exemplary embodiments of the present invention (both based on the structure of the first exemplary embodiment) shown respectively in FIGS. 6 and 10. That is, first connectors 26 are extended within openings 16*b*, 18*b* from each of the line sections 16*a*, 18*a* to corresponding indentations 16*d*, 18*d*, respectively. First connectors 26 are formed along the direction of address electrodes 8 (not shown) to divide openings 16*b*, 18*b* roughly in half. Also, third connectors 30 are formed interconnecting distal ends of adjacent extensions 16*c*, 18*c*.

Although not shown in the drawings, it is also possible to combine each of the structures of the third and fourth exemplary embodiments of the present invention with the structure of the sixth embodiment of the present invention. In particular, added to the structure of the sixth exemplary embodiment, a pair of first connectors 26' may be formed in each of the openings 16*b*, 18*b* such that a pair of first connectors 26' extends from each of the line sections 16*a*, 18*a* to corresponding indentations 16*d*, 18*d*, respectively. Also, added to the structure of the sixth exemplary embodiment, second connector 28 may be formed in each of the openings 16*b*, 18*b* in a direction substantially parallel to the direction of the line sections 16*a*, 18*a*, with one of the second connectors 28 extending from one predetermined point of extensions 16*c*, 18*c* to a point of the same directly opposite the first point to thereby interconnect these two areas of extensions 16*c*, 18*c*. It is also possible to add to the structure of the sixth exemplary embodiment both first and second connectors 26, 28 as described with reference to the second and fourth embodiments, respectively, and as shown in FIG. 9.

Figure 12:
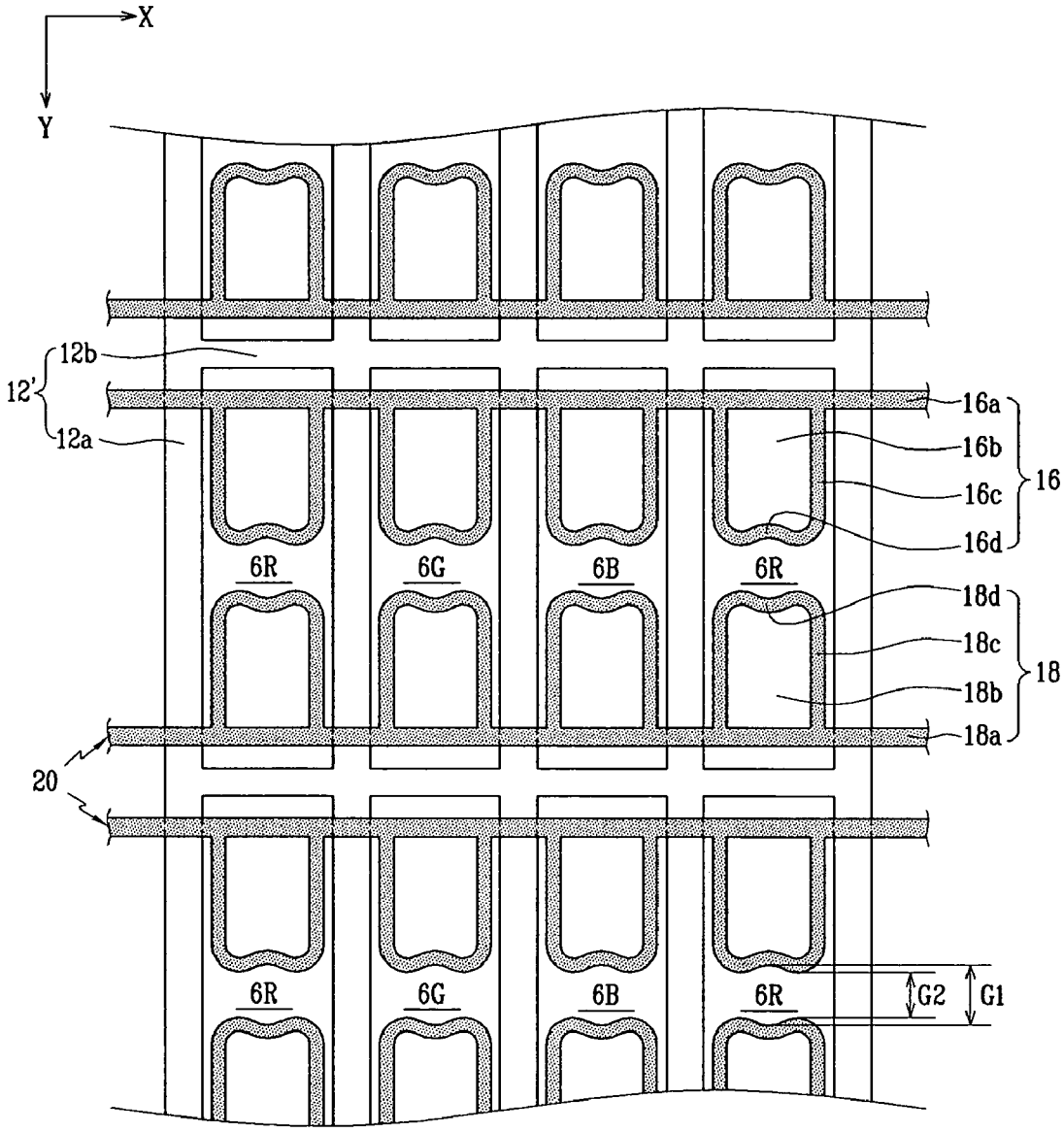
FIG. 12 is a partial plan view of a plasma display panel according to an eighth exemplary embodiment of the present invention.

FIG. 12 is a partial plan view of a plasma display panel according to an eighth exemplary embodiment of the present invention. Using the basic configuration of the first exemplary embodiment, barrier ribs 12' are formed in a lattice configuration, rather than in a stripe pattern. Barrier ribs 12' include first barrier rib members 12*a* formed along direction Y such that its long axes are substantially parallel to long axes of address electrodes (not shown), and second barrier rib members 12*b* formed along direction X such that its long axes are substantially perpendicular to the long axes of the address electrodes. With the use of the configuration, each of the discharge cells 6R, 6G, 6B is independently defined such that crosstalk between the same is prevented.

Figure 13:
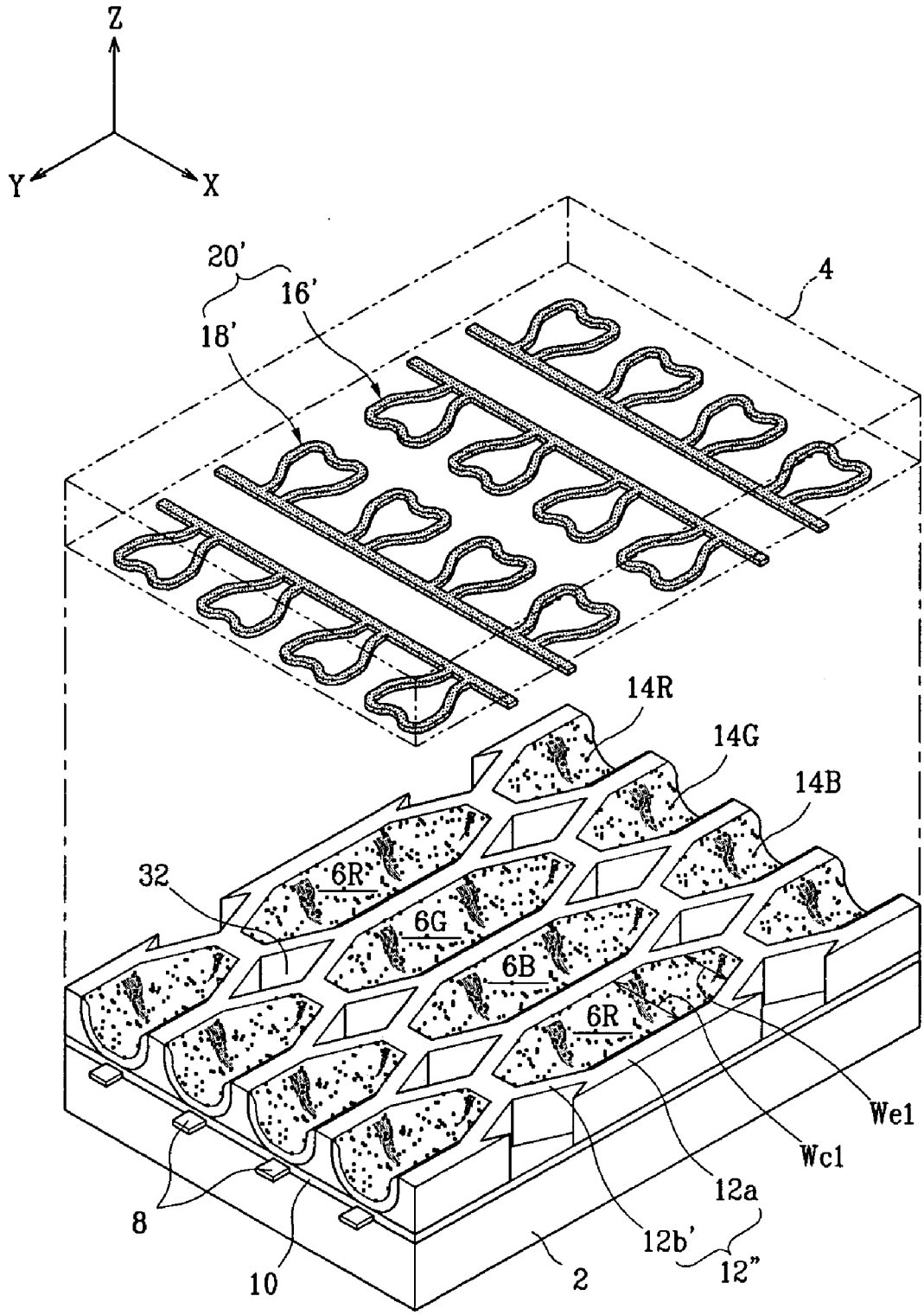
FIG. 13 is a partial plan view of a plasma display panel according to a ninth exemplary embodiment of the present invention.
Figure 14:
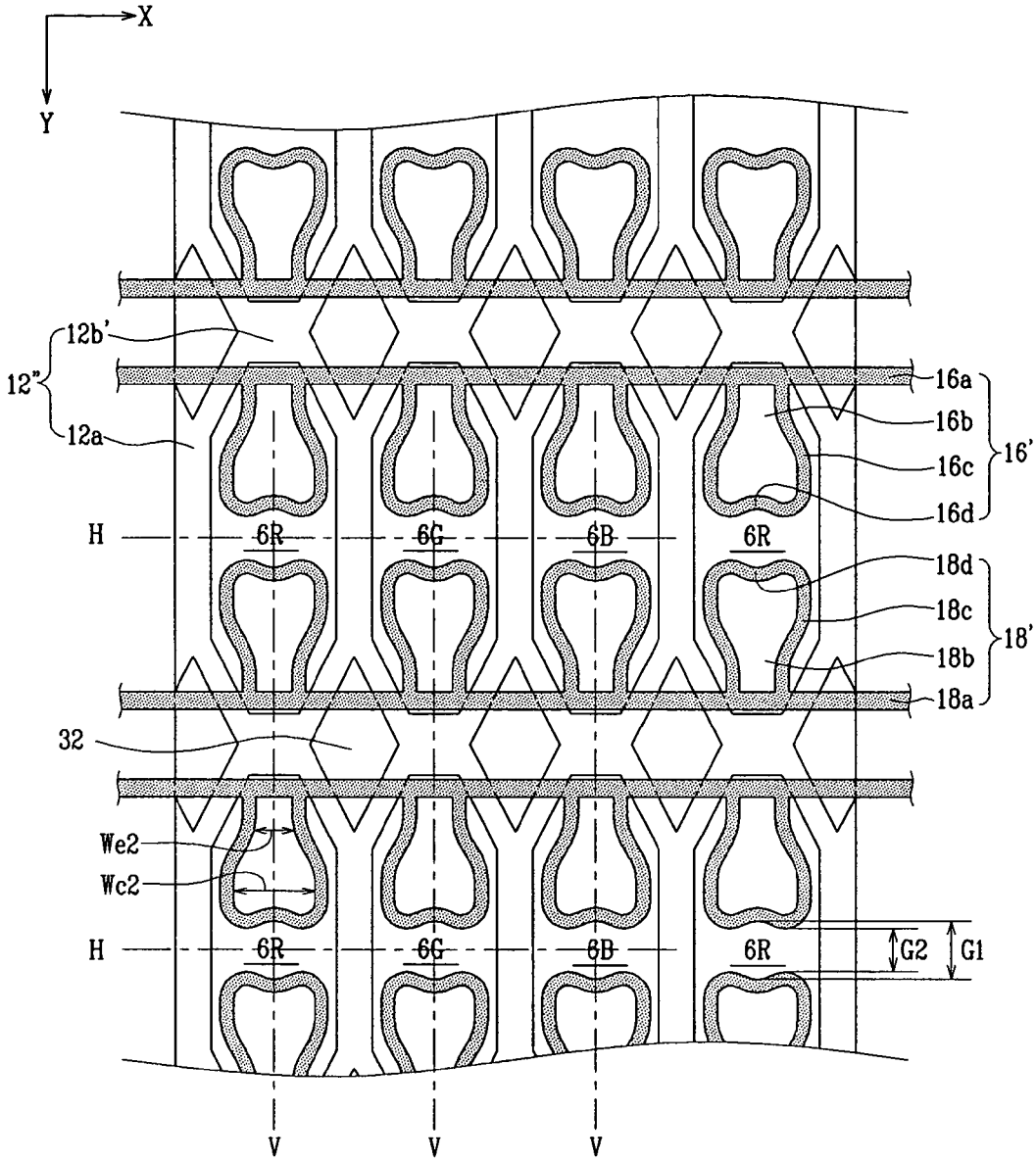
FIG. 14 is a plan view of the plasma display panel of FIG. 13.

FIG. 13 is a partial plan view of a plasma display panel according to a ninth exemplary embodiment of the present invention, and FIG. 14 is a plan view of the plasma display panel of FIG. 13. Barrier ribs 12" are formed defining discharge cells 6R, 6G, 6B, and non-discharge regions 32. Non-discharge regions 32 are areas where there is no gas discharge and no illumination.

The barrier ribs 12" define discharge cells 6R, 6G, 6B along the direction that address electrodes 8 (see FIG. 13) are formed (direction Y), and along the direction substantially perpendicular to the direction that address electrodes 8 are formed (direction X). Each of the discharge cells 6R, 6G, 6B is formed by barrier ribs 12" in such a manner as to optimize the spread of discharge gas. If imaginary horizontal axes H and vertical axes V are drawn passing through a center point of each of the discharge cells 6R, 6G, 6B, non-discharge regions 32 are positioned within the regions enclosed by the horizontal axes H and vertical axes V. Non-discharge regions 32 are formed into independent cell units by barrier ribs 12".

In more detail, with respect to this structure of discharge cells 6R, 6G, 6B to optimize the spread of discharge gas, ends of discharge cells 6R, 6G, 6B furthest from this center point (where the horizontal axes H intersect the vertical axes V) decrease in width along the direction X as the distance from the center point is increased. With reference to FIG. 13, width Wc1 at a center area of discharge cells 6R, 6G, 6B and along the direction X is larger than width We1 at the ends of discharge cells 6R, 6G, 6B along the same direction. As described above, this width We1 decreases in size along the direction X as the distance from the center point is increased. Barrier ribs 12" continue to decrease in width for a predetermined distance, then the ends of barrier ribs 12" are formed along the direction X so that ends thereof are interconnected. Hence, each of the discharge cells 6R, 6R, 6G has a plan view that the ends of the discharge cells furthest from the center point are formed in the shape of a trapezoid, and is octagonal as a whole.

With reference to FIG. 14, centers of non-discharge regions 32 are substantially at centers of the regions enclosed by the horizontal axes H and vertical axes V. Stated differently, for each row of discharge cells 6R, 6G, 6B along the direction substantially perpendicular to the direction address electrodes 8 are formed (direction X), each of the non-discharge regions 32 is surrounded by a pair of discharge cells 6R, 6G, 6B adjacent in the direction X and belonging to a first row, and a pair of discharge cells 6R, 6G, 6B adjacent in the direction X and belonging to a second row that is adjacent to the first row.

Barrier ribs 12" include first barrier rib members 12*a* that are substantially parallel to address electrodes 8, and second barrier rib members 12*b'* that are integrally formed to first barrier rib members 12*a* at a predetermined angle to the same. Second barrier rib members 12*b'* are extended along the direction substantially perpendicular to the direction address electrodes 8 are formed between the rows of discharge cells 6R, 6G, 6B to thereby interconnect distal ends of these angled portions of second barrier rib members 12*b'*. The end result is that second barrier rib members 12*b'* are formed substantially into an "X" shape between adjacent rows of discharge cells 6R, 6G, 6B.

In the ninth exemplary embodiment of the present invention, discharge sustain electrodes 20' use the basic configuration of the above embodiments. However, areas of extensions 16*c* of scanning electrodes 16' adjacent to line sections 16*a* of the same are formed roughly corresponding to the shape of discharge cells 6R, 6G, 6B described above. Similarly, areas of extensions 18*c* of display electrodes 18' adjacent to line sections 18*a* of the same are formed roughly corresponding to the shape of discharge cells 6R, 6G, 6B described above. That is, with reference to FIG. 14, width We2 of openings 16*b*, 18*b* at areas adjacent to line sections 16*a*, 18*a*, respectively, is smaller than width Wc2 of openings 16*b*, 18*b* at remaining areas. This difference in widths We2, Wc2 is made gradually by bending extensions 16*c*, 18*c* at predetermined curvatures first to reduce the size of openings 16*b*, 18*b* then in the opposite direction to maintain a predetermined size once reached.

With this configuration, areas of discharge cells 6R, 6G, 6B that contribute little to improving discharge and brightness are reduced in size. This is done with the knowledge that plasma discharge begins in the spaces between scanning electrodes 16' and display electrodes 18', that is, in gaps G1, G2, then spreads in a circular arc formation toward outer areas of discharge cells 6R, 6G, 6B.

Accordingly, the PDP according to the ninth exemplary embodiment of the present invention improves discharge efficiency by the formation of discharge cells 6R, 6G, 6B. Also, non-discharge regions 32 absorb the heat emitted from within discharge cells 6R, 6G, 6B and discharges the heat to outside the PDP, thereby enhancing the heat-dissipation characteristics of the PDP.

Figure 15:
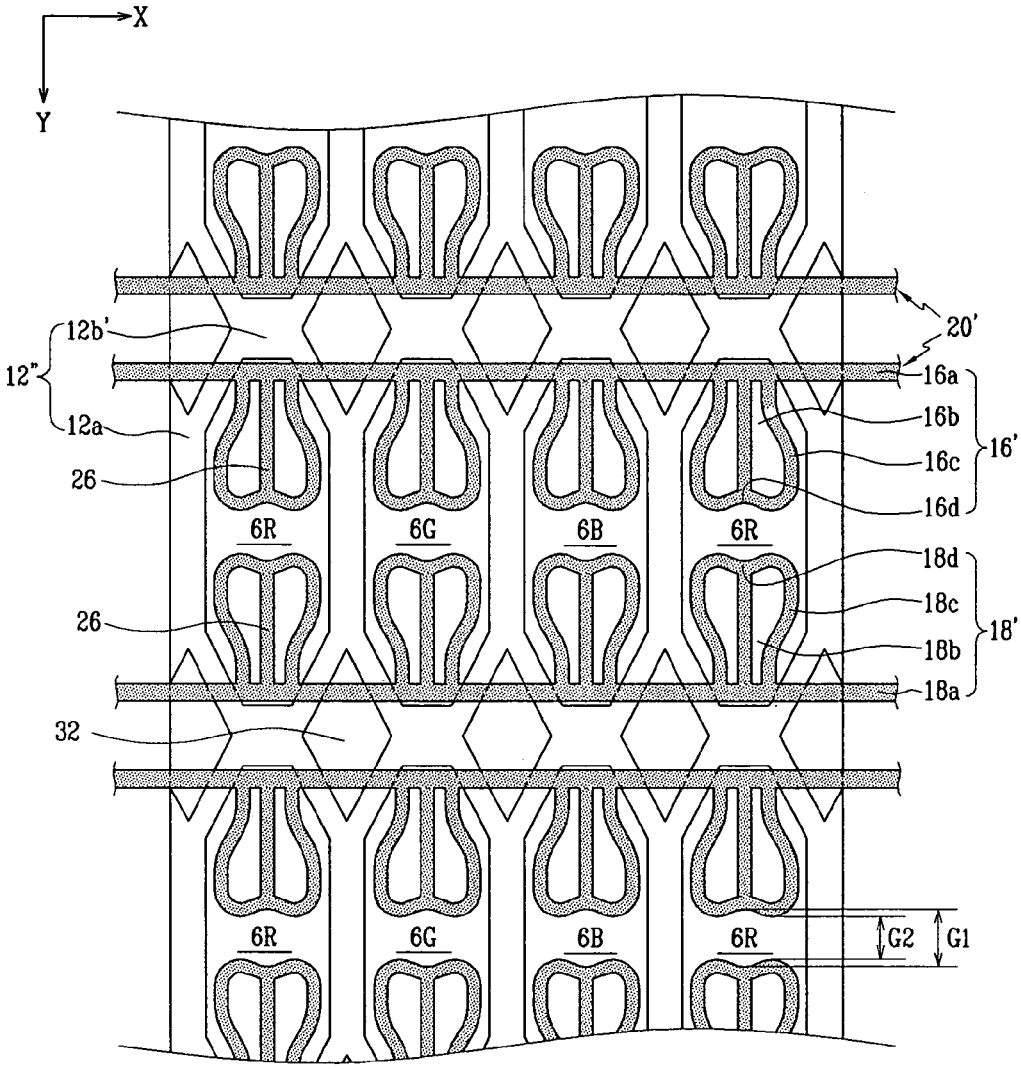
FIG. 15 is a partial plan view of a plasma display panel according to a tenth exemplary embodiment of the present invention.

FIG. 15 is a partial plan view of a plasma display panel according to a tenth exemplary embodiment of the present invention. Using the basic structure of the ninth exemplary embodiment of the present invention, first connectors 26 are extended within openings 16*b*, 18*b* from each of the line sections 16*a*, 18*a* to corresponding indentations 16*d*, 18*d*, respectively. First connectors 26 are formed along the direction of address electrodes 8 (not shown) to divide openings 16*b*, 18*b* roughly in half.

Figure 16:
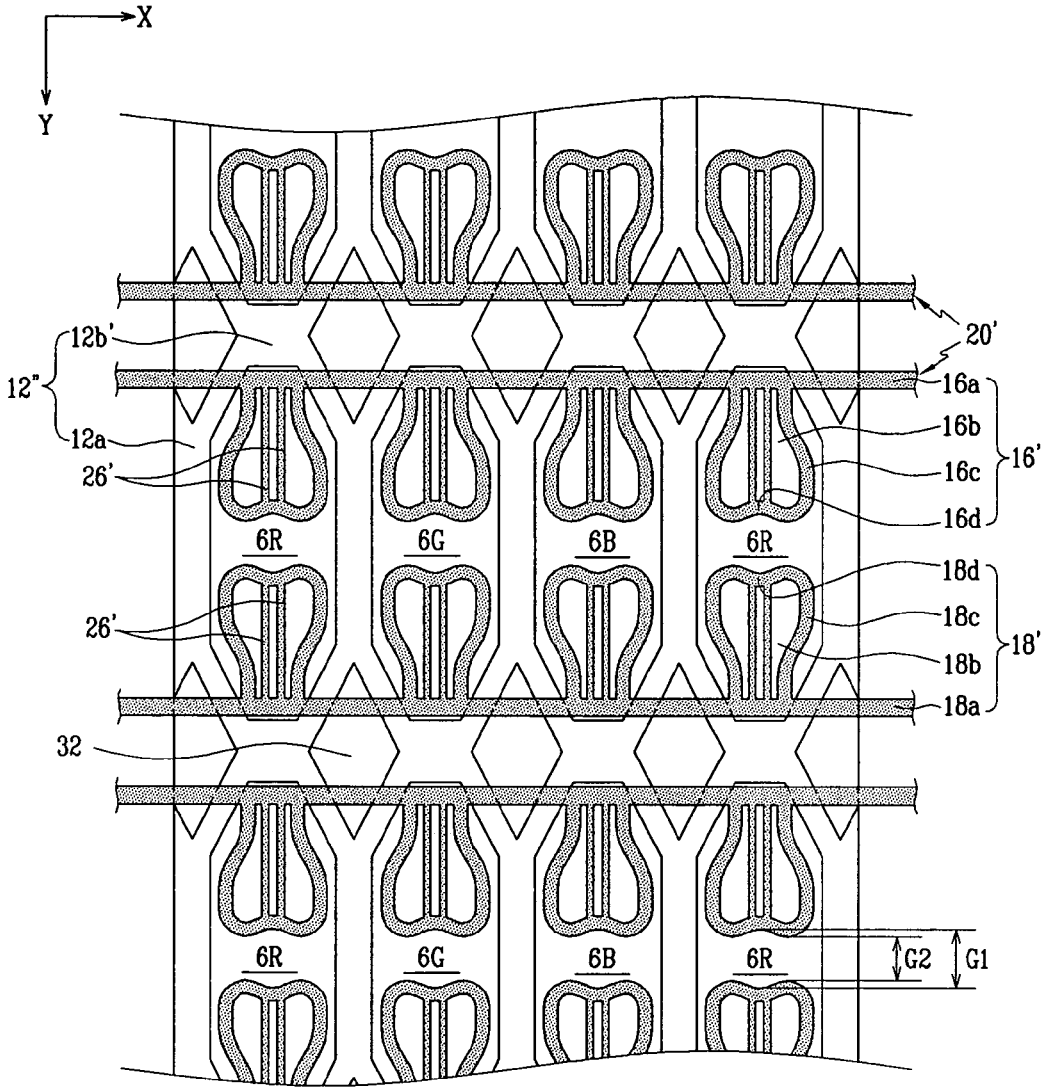
FIG. 16 is a partial plan view of a plasma display panel according to an eleventh exemplary embodiment of the present invention.

FIG. 16 is a partial plan view of a plasma display panel according to an eleventh exemplary embodiment of the present invention. Using the basic structure of the ninth exemplary embodiment of the present invention and similar to the structure of the tenth exemplary embodiment, a pair of first connectors 26' is formed in each of the openings 16*b*, 18*b*. That is, a pair of first connectors 26' extends from each of the line sections 16*a*, 18*a* to corresponding indentations 16*d*, 18*d*, respectively.

Figure 17:
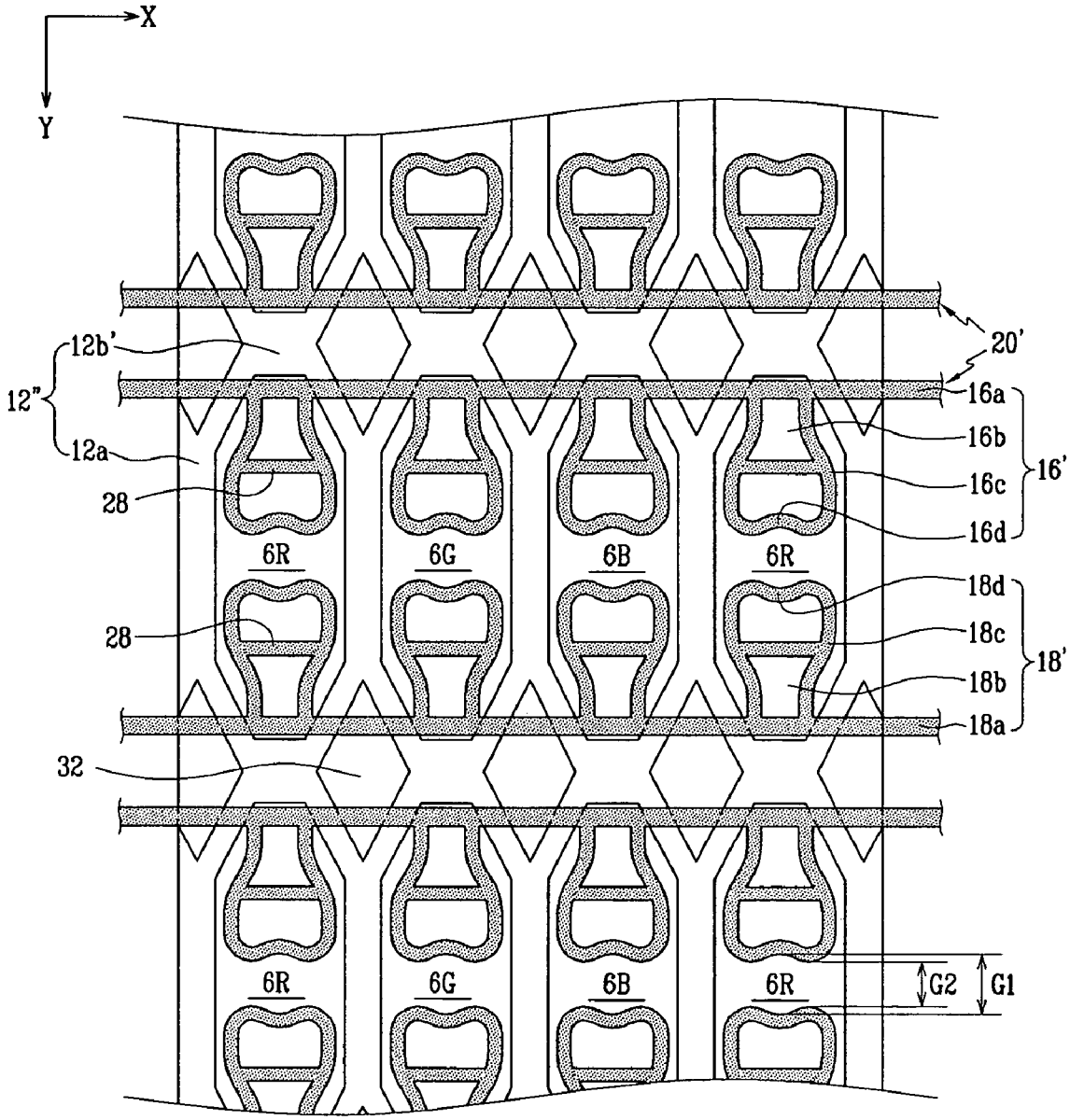
FIG. 17 is a partial plan view of a plasma display panel according to a twelfth exemplary embodiment of the present invention.

FIG. 17 is a partial plan view of a plasma display panel according to a twelfth exemplary embodiment of the present invention. Using the basic structure of the ninth exemplary embodiment of the present invention, second connector 28 is formed in each of the openings 16*b*, 18*b* in a direction substantially parallel to the direction of line sections 16*a*, 18*a*. For each of the extensions 16*c*, 18*c*, one of the second connectors 28 extends from one predetermined point of extensions 16*c*, 18*c* to a point of the same directly opposite to the first point to thereby interconnect these two areas of extensions 16*c*, 18*c*.

Figure 18:
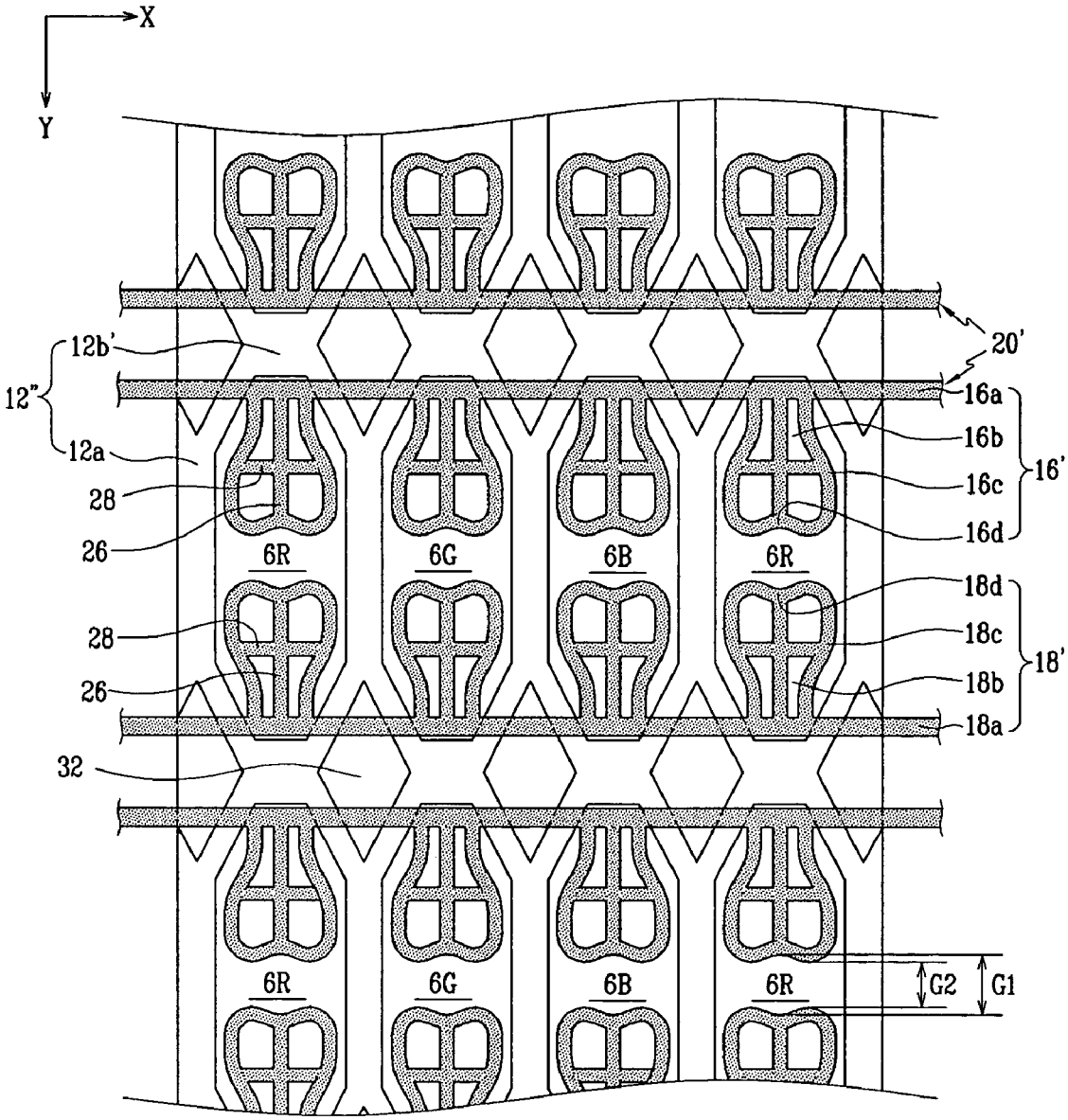
FIG. 18 is a partial plan view of a plasma display panel according to a thirteenth exemplary embodiment of the present invention.

FIG. 18 is a partial plan view of a plasma display panel according to a thirteenth exemplary embodiment of the present invention. This exemplary embodiment is a combination of the tenth and twelfth exemplary embodiments of the present invention (both based on the structure of the ninth exemplary embodiment) shown respectively in FIGS. 15 and 17. That is, first connectors 26 are extended within openings 16*b*, 18*b* from each of the line sections 16*a*, 18*a* to corresponding indentations 16*d*, 18*d*, respectively. First connectors 26 are formed along the direction of address electrodes 8 (not shown) to divide openings 16*b*, 18*b* roughly in half. Further, second connector 28 is formed in each of the openings 16*b*, 18*b* in a direction substantially parallel to the direction of line sections 16*a*, 18*a*. For each of the extensions 16*c*, 18*c*, one of the second connectors 28 extends from one predetermined point of extensions 16*c*, 18*c* to a point of the same directly opposite to the first point to thereby interconnect these two areas of the extensions 16*c*, 18*c*.

Figure 19:
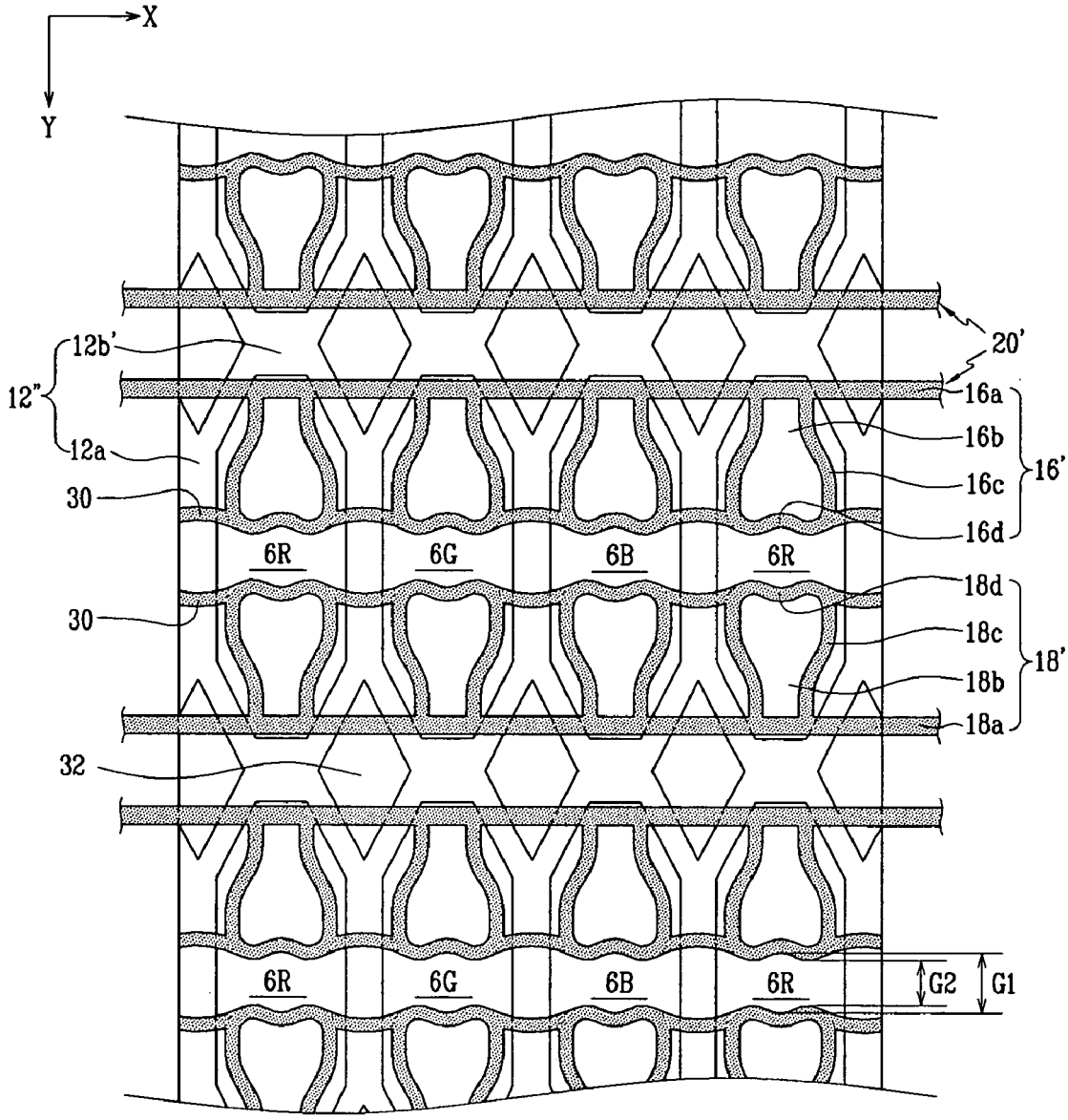
FIG. 19 is a partial plan view of a plasma display panel according to a fourteenth exemplary embodiment of the present invention.

FIG. 19 is a partial plan view of a plasma display panel according to a fourteenth exemplary embodiment of the present invention. Using the basic configuration of the ninth exemplary embodiment of the present invention, third connectors 30 are formed interconnecting distal ends of adjacent extensions 16*c*, 18*c*.

The functions of first connectors 26, second connectors 28, and third connectors 30 described with reference to the tenth through fourteenth exemplary embodiments are identical to those described with reference to the second through sixth exemplary embodiments. A detailed description, therefore, will not be provided.

Figure 20:
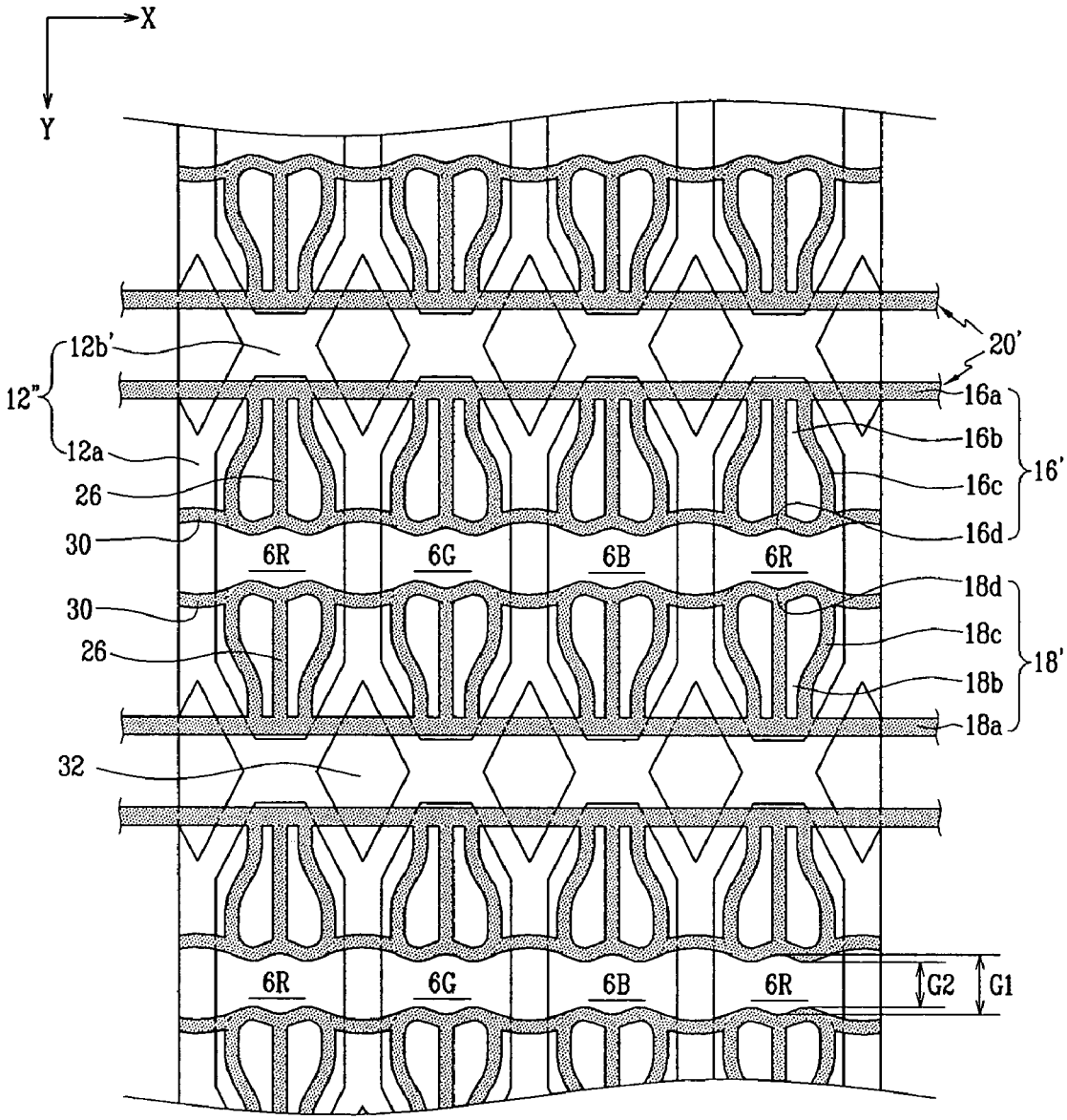
FIG. 20 is a partial plan view of a plasma display panel according to a fifteenth exemplary embodiment of the present invention.

FIG. 20 is a partial plan view of a plasma display panel according to a fifteenth exemplary embodiment of the present invention. This exemplary embodiment is a combination of the tenth and fourteenth exemplary embodiments of the present invention (both based on the structure of the ninth exemplary embodiment) shown respectively in FIGS. 15 and 19. That is, first connectors 26 are extended within openings 16*b*, 18*b* from each of the line sections 16*a* and 18*a* to corresponding indentations 16*d*, 18*d*, respectively. First connectors 26 are formed along the direction of address electrodes 8 (not shown) to divide openings 16*b*, 18*b* roughly in half. Also, third connectors 30 are formed interconnecting distal ends of adjacent extensions 16*c*, 18*c*.

Although not shown in the drawings, it is also possible to combine each of the structures of the eleventh and twelfth exemplary embodiments of the present invention with the structure of the fourteenth embodiment of the present invention. In particular, added to the structure of the fourteenth exemplary embodiment, a pair of first connectors 26' may be formed in each of the openings 16*b*, 18*b* such that the pair of first connectors 26' extends from each of the line sections 16*a*, 18*a* to corresponding indentations 16*d*, 18*d*, respectively. Also, second connector 28 may be formed in each of the openings 16*b*, 18*b* in a direction substantially parallel to the direction of line sections 16*a*, 18*a*, with one of the second connectors 28 extending from one predetermined point of extensions 16*c*, 18*c* to a point of the same directly opposite to the first point to thereby interconnect these two areas of extensions 16*c*, 18*c*. It is also possible to add to the structure of the fourteenth exemplary embodiment both first and second connectors 26, 28 as in the thirteenth exemplary embodiment shown in FIG. 18.

Figure 21:
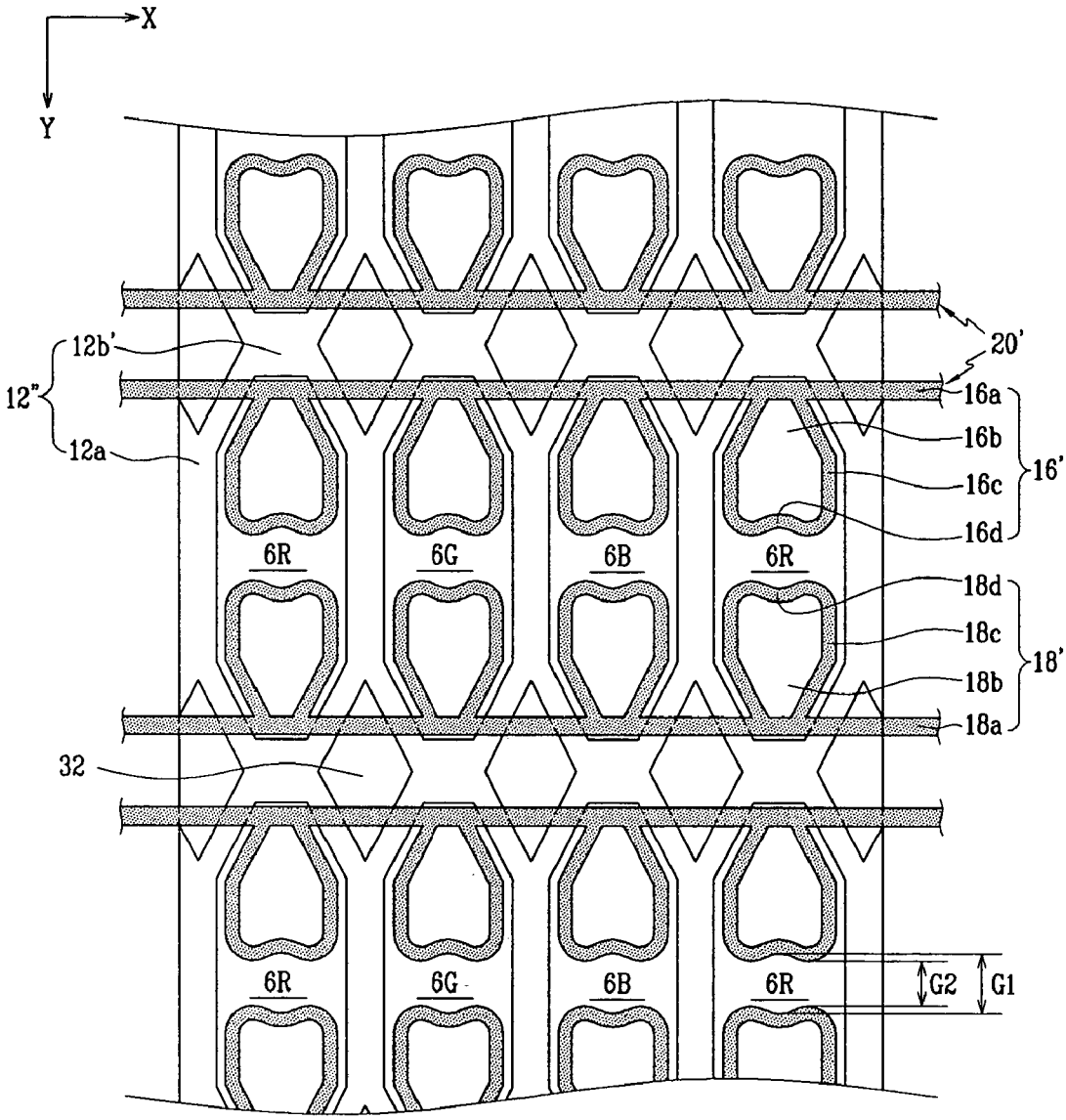
FIG. 21 is a partial plan view of a plasma display panel according to a sixteenth exemplary embodiment of the present invention.

FIG. 21 is a partial plan view of a plasma display panel according to a sixteenth exemplary embodiment of the present invention. Using the basic configuration of the ninth exemplary embodiment, extensions 16*c*, 18*c* are bent at a predetermined angle and at a predetermined point that is a predetermined distance from line sections 16*a*, 18*a*, respectively. The bend is abrupt, as opposed to being gradual as in the ninth embodiment, and once made, extensions 16*c*, 18*c* are not again bent and remain substantially straight until reaching the area of connection with line sections 16*a*, 18*a*, respectively. This bend at a predetermined angle of extensions 16*c*, 18*c* is such that a width of openings 16*b*, 18*b* formed by extensions 16*c*, 18*c* decreases at a fixed rate until reaching the area of connections with line sections 16*a*, 18*a*, respectively. Although not appearing in the drawings, first connectors 26, second connectors 28, and third connectors 30 as described with reference to the tenth through fifteenth exemplary embodiments may easily be applied to the configuration of the sixteenth exemplary embodiment of the present invention.

When compared to the conventional PDP using transparent electrodes, the PDP of the present invention described above provides for lower manufacturing costs, and increases an intensity of sustain discharge to reduce a drive voltage needed for the same. Furthermore, in the PDP of the present invention, sustain discharge occurs over a larger region within the discharge cells to thereby make sustain discharge more stable, increase illumination efficiency, and make brightness in the discharge cells more uniform.

Although embodiments of the present invention have been described in detail hereinabove in connection with certain exemplary embodiments, it should be understood that the invention is not limited to the disclosed exemplary embodiments, but, on the contrary is intended to cover various modifications and/or equivalent arrangements included within the spirit and scope of the present invention, as defined in the appended claims.

What is claimed is:

1. A plasma display panel, comprising:

a first substrate and a second substrate opposing one another with a gap therebetween;

address electrodes on a surface of the first substrate opposing the second substrate;

barrier ribs in the gap between the first substrate and the second substrate, the barrier ribs defining discharge cells;

a phosphor layer in each of the discharge cells; and non-transparent discharge sustain electrodes on a surface of the second substrate opposing the first substrate, wherein the non-transparent discharge sustain electrodes include line sections, a pair of line sections corresponding to each discharge cell and having extensions extending from the line sections into each of the discharge cells, the extensions defining openings, such that a pair of the extensions, one from each of the pair of line sections, oppose one another within each of the discharge cells, wherein distal ends of the extensions are curved, and wherein indentations are in substantially central portions of the distal ends of the extensions such that discharge gaps of differing sizes are between the distal ends of each pair of the extensions, the differing sizes being largest at the indentations.

2. The plasma display panel of claim 1, wherein the address electrodes are in a stripe pattern, and long axes of the line sections of the non-transparent discharge sustain electrodes and long axes of the address electrodes are substantially perpendicular.

3. The plasma display panel of claim 1, wherein a lower dielectric layer is on the first substrate covering the address electrodes, and an upper dielectric layer is on the second substrate covering the non-transparent discharge sustain electrodes.

4. The plasma display panel of claim 1, wherein areas of the distal ends of the extensions to both sides of the indentations are at a predetermined curvature.

5. The plasma display panel of claim 1, wherein the line sections and the extensions have a width in the range of 20-150 μm.

6. The plasma display panel of claim 1, wherein the non-transparent discharge sustain electrodes further comprise first connectors such that one of the first connectors extends within each of the openings to interconnect a coaesponding line section and indentation.

7. The plasma display panel of claim 6, wherein a pair of the first connectors extends within each of the openings.

8. The plasma display panel of claim 1, wherein the non-transparent discharge sustain electrodes further comprise a second connector in each of the openings in a direction substantially parallel to the direction of the line sections, such that for each of the extensions, the second connector extends horn a first predetermined point of a first leg of one of the pairs of extensions and interconnects a second predetermined point on a second leg of the one of the pairs of extensions.

9. The plasma display panel of claim 1, wherein the non-transparent discharge sustain electrodes further comprise first connectors such that one of the first connectors extends within each of the openings to interconnect the corresponding line section and the indentation, and a second connector in each of the openings in a direction substantially parallel to the direction of the line sections, such that for each of the extensions, the second connector extends from a first leg of one of the pairs of extensions and interconnects a second leg of the one of the pairs of extensions.

10. The plasma display panel of claim 1, wherein the non-transparent discharge sustain electrodes further comprise third connectors interconnecting distal ends of adjacent extensions.

11. The plasma display panel of claim 10, wherein the non-transparent discharge sustain electrodes further comprise at least one of first connectors such that one of the first connectors extends within each of the openings to interconnect a corresponding line section and indentation, and a second connector in each of the openings in a direction substantially parallel to the direction of the line sections, such that for each of the extensions, the second connector extends from a first leg of one of the pairs of extensions and interconnects a second leg of the one of the pairs of extensions.

12. The plasma display panel of claim 1, wherein a width of each of the openings defined by the extensions is smaller at an area adjacent to where the extensions are connected to the line sections than at a distal end area of the extensions.

13. The plasma display panel of claim 12, wherein a difference in the widths is made by bending the extensions to have a predetermined curvature such tart the width at the area adjacent to where the extensions are connected to the line sections gradually decreases.

14. The plasma display panel of claim 12, wherein the difference in the widths is made by bending the extensions at a predetermined angle such that the width at the area adjacent to where the extensions are connected to the line sections gradually decreases.

15. The plasma display panel of claim 2, wherein the barrier ribs are in a stripe pattern with long axes substantially parallel to long axes of the address electrodes.

16. The plasma display panel of claim 1, wherein the baffler ribs are in a lattice configuration and comprise first barrier rib members with long axes substantially parallel to long axes of the address electrodes, and second barrier rib members with long axes substantially perpendicular to the long axes of the address electrodes.

17. The plasma display panel of claim 1, wherein the discharge cells and non-discharge regions are defined by the barrier ribs, the non-discharge regions being within respective regions enclosed by adjacent first axes through center points of adjacent discharge cells along a direction substantially perpendicular to the direction of the address electrodes and by adjacent second axes through center points of adjacent discharge cells along the direction of the address electrodes.

18. The plasma display panel of claim 17, wherein ends of the discharge cells furthest from a center point where the first axes intersect the second axes decrease in width along the direction substantially perpendicular to the direction of the address electrodes as the distance from the center point is increased.

19. A plasma display panel, comprising:

a first substrate and a second substrate opposing one another with a gap therebetween;

address electrodes on a surface of the first substrate opposing the second substrate;

barrier ribs in the gap between the first substrate and the second substrate, the barrier ribs defining discharge cells;

phosphor layer in each of the discharge cells; and non-transparent discharge sustain electrodes on a surface of the second substrate opposing the first substrate, wherein non-discharge regions are within respective regions enclosed by adjacent first axes through center points of adjacent discharge cells along a direction substantially perpendicular to the direction of the address electrodes and by adjacent second axes through center points of adjacent discharge cells along the direction of the address electrodes, wherein the non-transparent discharge sustain electrodes include line sections, each pair of which corresponds to a discharge cell, and extensions formed extending from the line sections into each of the discharge cells, the extensions defining openings, such that a pair of the extensions oppose one another within each of the discharge cells, wherein distal ends of the extensions are curved, and wherein indentations are in substantially central portions of the distal ends of the extensions such that discharge gaps of diffeiing sizes are between the distal ends of each pair of the extensions, the differing sizes being largest at the indentations.

20. The plasma display panel of claim 19, wherein ends of the discharge cells furthest from a center point where the first axes intersect the second axes decrease in width along the direction substantially perpendicular to the direction of the address electrodes as the distance from the center point is increased.

21. The plasma display panel of claim 20, wherein ends of the discharge cells furthest from the center point along the direction of the address electrodes, are in the shape of a trapezoid.

22. The plasma display panel of claim 19, wherein the non-discharge regions are defined by the barrier ribs as independent cell units.

23. The plasma display panel of claim 19, wherein the nan-discharge regions are substantially in centers of the regions enclosed by the first axes and the second axes.

24. The plasma display panel of claim 19, wherein the barrier ribs comprise first barrier rib members with long axes substantially parallel to long axes of the address electrodes, and second barrier rib members with long axes substantially perpendicular to the long axes of the address electrodes.

25. The plasma display panel of claim 24, wherein the second barrier rib members are substantially in an X-shape between discharge cells adjacent along the direction of the address electrodes.

26. The plasma display panel of claim 19, wherein a width of each of the openings defined by the extensions is smaller at an area adjacent to where the extensions are connected to the line sections than at the distal end of the extensions.

27. The plasma display panel of claim 26, wherein a difference in the widths is made by bending the extensions to have a curvature such that the width at the area adjacent to where the extensions are connected to the line sections gradually decreases.

28. The plasma display panel of claim 26, wherein a difference in the widths is made by bending the extensions at an angle such that the width at the area adjacent to where the extensions are connected to the line sections gradually decreases.

29. The plasma display panel of claim 26, wherein the non-transparent discharge sustain electrodes further comprise first connectors such that one of the first connectors extends within each of the openings to interconnect a corresponding line section and indentation.

30. The plasma display panel of claim 29, wherein a pair of the first connectors extends within each of the openings.

31. The plasma display panel of claim 26, wherein the non-transparent discharge sustain electrodes further comprise a second connector in each of the openings in a direction substantially parallel to the direction of the line sections, such that for each of the extensions, the second connector extends from a first leg of one of the pairs of extensions and interconnects a second leg of the one of the pairs of extensions.

32. The plasma display panel of claim 26, wherein the non-transparent discharge sustain electrodes further comprise first connectors such that one of the first connectors extends within each of the openings to interconnect the corresponding line section and the indentation, and a second connector in each of the openings in a direction substantially parallel to the direction of the line sections, such that for each of the extensions, the second connector extends from a first leg of one of the pairs of extensions and interconnects a second leg of the one of the pairs of extensions.

33. The plasma display panel of claim 26, wherein the non-transparent discharge sustain electrodes further comprise third connectors interconnecting distal ends of adjacent extensions.

34. The plasma display panel of claim 33, wherein the non-transparent discharge sustain electrodes further comprise at least one of first connectors such that one of the first connectors extends within each of the openings to interconnect the corresponding line section and the indentation, and a second connector in each of the openings in a direction substantially parallel to the direction of the line sections, such that for each of the extensions, the second connector extends from a first leg of one of the pairs of extensions and interconnects a second leg of the one of the pairs of extensions.

* * * * *

UNITED STATES PATENT AND TRADEMARK OFFICE

CERTIFICATE OF CORRECTION

PATENT NO. : 7,358,671 B2
APPLICATION NO. : 10/890660
DATED : April 15, 2008
INVENTOR(S) : Jae-Ik Kwon It is certified that error appears in the above-identified patent and that said Letters Patent is hereby corrected as shown below:

| | |
|---|---|
| Column 12, line 38, Claim 6 | Delete "coaesponding",<br>Insert --corresponding-- |
| Column 12, line 46, Claim 8 | Delete "horn",<br>Insert --from-- |
| Column 13, line 14, Claim 13 | Delete "tart",<br>Insert --that-- |
| Column 13, line 26, Claim 16 | Delete "baffler",<br>Insert --barrier-- |
| Column 13, line 54, Claim 19 | Before "phosphor",<br>Insert --a-- |
| Column 13, line 66, Claim 19 | Delete "formed" |
| Column 14, line 7, Claim 19 | Delete "diffeiing",<br>Insert --differing-- |
| Column 14, line 24, Claim 23 | Delete "nan-discharge",<br>Insert --non-discharge-- |

Signed and Sealed this

Twenty-third Day of December, 2008

JON W. DUDAS
*Director of the United States Patent and Trademark Office*